US009005428B2

(12) United States Patent
Freel et al.

(10) Patent No.: US 9,005,428 B2
(45) **Date of Patent: *Apr. 14, 2015**

(54) PRODUCTS PRODUCED FROM RAPID THERMAL PROCESSING OF HEAVY HYDROCARBON FEEDSTOCKS

(75) Inventors: Barry Freel, Greely (CA); Robert G. Graham, Greely (CA)

(73) Assignee: Ivanhoe HTL Petroleum Ltd., Houston, TX (US)

( * ) Notice: Subject to any disclaimer, the term of this patent is extended or adjusted under 35 U.S.C. 154(b) by 177 days.

This patent is subject to a terminal disclaimer.

(21) Appl. No.: 13/286,974

(22) Filed: Nov. 1, 2011

(65) Prior Publication Data

US 2012/0111766 A1 May 10, 2012

Related U.S. Application Data

(63) Continuation of application No. 11/713,520, filed on Mar. 1, 2007, now Pat. No. 8,062,503, which is a continuation of application No. 09/955,267, filed on Sep. 18, 2001, now Pat. No. 7,270,743.

(60) Provisional application No. 60/233,354, filed on Sep. 18, 2000.

(51) Int. Cl.
*C10G 1/06* (2006.01)
*C10G 9/30* (2006.01)

(52) U.S. Cl.
CPC ..... *C10G 9/30* (2013.01); *C10G 2400/06* (2013.01); *C10G 2300/201* (2013.01); *C10G 2300/302* (2013.01); *C10G 2300/304* (2013.01); *C10G 2300/308* (2013.01)

(58) Field of Classification Search
CPC ..... C10G 1/06
USPC ..... 208/411, 419, 85, 95, 146, 15, 126, 208/127, 14
See application file for complete search history.

(56) References Cited

U.S. PATENT DOCUMENTS 2,573,906 A 11/1951 Huff
2,735,804 A 2/1956 Boston et al.

(Continued)

FOREIGN PATENT DOCUMENTS

CA 932686 A1 8/1973
CA 1050736 A1 3/1979

(Continued)

OTHER PUBLICATIONS

European Examination Report, Application No. EP 10075528.9, Feb. 27, 2012.

(Continued)

*Primary Examiner* — Walter D Griffin
*Assistant Examiner* — Huy-Tram Nguyen
(74) *Attorney, Agent, or Firm* — Orrick, Herrington & Sutcliffe, LLP

(57) ABSTRACT

The present invention is directed to the upgrading of heavy hydrocarbon feedstock that utilizes a short residence pyrolytic reactor operating under conditions that cracks and chemically upgrades the feedstock. The process of the present invention provides for the preparation of a partially upgraded feedstock exhibiting reduced viscosity and increased API gravity. This process selectively removes metals, salts, water and nitrogen from the feedstock, while at the same time maximizes the yield of the liquid product, and minimizes coke and gas production. Furthermore, this process reduces the viscosity of the feedstock in order to permit pipeline transport, if desired, of the upgraded feedstock with little or no addition of diluents.

10 Claims, 5 Drawing Sheets

(56) References Cited

U.S. PATENT DOCUMENTS

| | | | | |
|---|---|---|---|---|
| 3,472,758 | A | 10/1969 | Stine et al. | |
| 3,544,448 | A | 12/1970 | Jacobs et al. | |
| 3,582,276 | A | 6/1971 | Campbell et al. | |
| 3,607,171 | A | 9/1971 | Hirsch | |
| 3,850,739 | A | 11/1974 | Wunderlich et al. | |
| 3,853,498 | A | 12/1974 | Bailie | |
| 3,929,619 | A | 12/1975 | Sinfelt et al. | |
| 4,039,390 | A | 8/1977 | Logan | |
| 4,064,018 | A | 12/1977 | Choi | |
| 4,080,285 | A | 3/1978 | Mckinney et al. | |
| 4,083,751 | A | 4/1978 | Choi et al. | |
| 4,085,030 | A | 4/1978 | Green et al. | |
| 4,087,347 | A | 5/1978 | Langlois et al. | |
| 4,102,773 | A | 7/1978 | Green et al. | |
| 4,106,999 | A | 8/1978 | Koppelman et al. | |
| 4,108,732 | A | 8/1978 | Nuttall, Jr. | |
| 4,141,794 | A | 2/1979 | Choi | |
| 4,147,593 | A | 4/1979 | Frischmuth et al. | |
| 4,153,514 | A | 5/1979 | Garrett et al. | |
| 4,161,442 | A | 7/1979 | Audeh et al. | |
| 4,186,079 | A | 1/1980 | Roberts | |
| 4,211,606 | A | 7/1980 | Ponomarev et al. | |
| 4,232,514 | A | 11/1980 | Flatt | |
| 4,243,514 | A | 1/1981 | Bartholic | |
| 4,252,634 | A | 2/1981 | Khulbe et al. | |
| 4,260,456 | A | 4/1981 | Schulman | |
| 4,263,128 | A | 4/1981 | Bartholic | |
| 4,280,876 | A | 7/1981 | Green | |
| 4,294,686 | A | 10/1981 | Fisher et al. | |
| 4,298,453 | A | 11/1981 | Schoennagel et al. | |
| 4,311,580 | A | 1/1982 | Bartholic | |
| 4,322,222 | A | 3/1982 | Sass | |
| 4,328,091 | A | 5/1982 | Bartholic | |
| 4,409,416 | A | 10/1983 | Snell et al. | |
| 4,427,538 | A | 1/1984 | Bartholic | |
| 4,427,539 | A | 1/1984 | Busch et al. | |
| 4,428,862 | A | 1/1984 | Ward et al. | |
| 4,435,272 | A | 3/1984 | Bartholic et al. | |
| 4,490,243 | A | 12/1984 | Miyauchi et al. | |
| 4,507,195 | A | 3/1985 | Spars et al. | |
| 4,569,753 | A | 2/1986 | Busch et al. | |
| 4,578,183 | A | 3/1986 | Chou et al. | |
| 4,617,107 | A | 10/1986 | Mandelson et al. | |
| 4,668,378 | A | 5/1987 | Miyauchi et al. | |
| 4,693,808 | A | 9/1987 | Dewitz | |
| 4,772,378 | A | 9/1988 | Miyauchi et al. | |
| 4,814,067 | A | 3/1989 | Gartside et al. | |
| 4,816,136 | A | 3/1989 | Allan et al. | |
| 4,818,373 | A | 4/1989 | Bartholic et al. | |
| 4,828,681 | A | 5/1989 | Yourtee et al. | |
| 4,919,898 | A | 4/1990 | Gartside et al. | |
| 4,980,045 | A | 12/1990 | Krishna et al. | |
| 4,985,136 | A | 1/1991 | Bartholic | |
| 5,024,750 | A * | 6/1991 | Sughrue et al. | 208/57 |
| 5,073,666 | A | 12/1991 | Zemanian et al. | |
| 5,092,984 | A | 3/1992 | Babu et al. | |
| 5,120,428 | A | 6/1992 | Ikura et al. | |
| 5,136,117 | A | 8/1992 | Paisley et al. | |
| 5,275,720 | A | 1/1994 | Ward | |
| 5,296,131 | A | 3/1994 | Raterman | |
| 5,326,919 | A | 7/1994 | Paisley et al. | |
| 5,338,322 | A | 8/1994 | Ignasiak et al. | |
| 5,370,789 | A | 12/1994 | Milne et al. | |
| 5,413,702 | A | 5/1995 | Yan | |
| 5,626,741 | A * | 5/1997 | Mosby et al. | 208/113 |
| 5,626,742 | A | 5/1997 | Brons et al. | |
| 5,662,868 | A | 9/1997 | Letzsch et al. | |
| 5,723,040 | A | 3/1998 | Letzsch et al. | |
| 5,792,340 | A * | 8/1998 | Freel et al. | 208/127 |
| 5,807,478 | A | 9/1998 | Myers et al. | |
| 5,858,213 | A * | 1/1999 | Chomyn | 208/350 |
| 5,961,786 | A | 10/1999 | Freel et al. | |
| 6,123,832 | A | 9/2000 | Ho et al. | |
| 6,814,940 | B1 | 11/2004 | Hiltunen et al. | |
| 7,270,743 | B2 * | 9/2007 | Freel et al. | 208/411 |
| 8,062,503 | B2 * | 11/2011 | Freel et al. | 208/14 |
| 2007/0066860 | A1 | 3/2007 | Buchanan et al. | |

FOREIGN PATENT DOCUMENTS

| | | | |
|---|---|---|---|
| CA | 1090732 | A1 | 12/1980 |
| CA | 1108545 | A1 | 9/1981 |
| CA | 1283880 | C | 5/1991 |
| EP | 0 513051 | B1 | 12/1994 |
| GB | 2117394 | A | 10/1983 |
| WO | WO 91/11499 | A1 | 8/1991 |
| WO | WO 00/61705 | A1 | 10/2000 |

OTHER PUBLICATIONS

A. Serper, "Resources Recovery Field Stands Poised Between Problems, Solutions," Solid Wastes Management Journal, pp. 16, 86, May 1980.

B. H. Levelton, et al., An Evaluation of Wood Waste Energy Conversion Systems, Enfor Project No. C-111, p. 5-62, Dec. 1980, Vancouver, B.C.

C. Bliss, et al., "Silviculturel Biomass Farms, vol. V, Conversion Processes and Costs," MITRE Technical Report No. 7347, vol. 5, p. 68, May 1977.

C. L. Oberg, et al., "Coal Liquefaction by Flash Hydropyrolysis," Coal Processing Technology 6, pp. 159-165, 1980, California.

D. A. Berg, et al. "Characterization of Solids Mixing in an Ultra-Rapid Fluidized Reactor," Powder & Bulk Solids Conference, 1986, Illinois.

D. A. Berg, et al., "Rapid Mixing Studies Between Transported Solids in an Ultra-Rapid Fluidized Reactor," Powder & Bulk Solids Conference, 1985, Illinois.

G. R. Gavalas, "Coal Pyrolysis," Coal Science and Technology 4, pp. 70-76, 1982.

G.T. Preston, "Resources Recovery and Flash Pyrolysis of Municipal Refuse," Institute of Gas Technology Symposium, Jan. 1976, pp. 1-28, Florida.

International Search Report, dated Jul. 26, 2002, for corresponding International Application PCl/CA01/01316.

J.J. Fritz et al., "Status Review of Wood Biomass: Gasification, Pyrolysis, and Densification Technologies," pp. 66-67, Jan. 1979.

N. W. Sorbo, et al., "Technical and Economic Feasibility of Small Scale Co-Gasification of Densified Sludge and Solid Waste," Symposium Papers Excerpt, Energy from Biomass and Wastes VI, pp. 587, 596, 628, Jan. 1982, Florida.

S. T. DiNovo, et al., "Preliminary Assessment of Biomass Conversion to Synthetic Fuels," Contract No. 68-02-1323, Industrial Environmental Research Laboratory, pp. 123, 125-127, Oct. 1978, Ohio.

Symposium Papers Excerpt, "Energy from Biomass and Wastes IV," pp. 1, 25, Jan. 1980, Florida.

Symposium Papers Excerpt, "Energy from Biomass and Wastes V," pp. 1, 41, Jan. 26-30, 1981, Florida.

Textbook Excerpts, "Occidental Flash Pyrolysis," pp. 285-286; "Rockwell Flash Pyrolysis," pp. 285-287 (No Dates).

* cited by examiner

PRODUCTS PRODUCED FROM RAPID THERMAL PROCESSING OF HEAVY HYDROCARBON FEEDSTOCKS

CROSS-REFERENCE TO RELATED APPLICATION

This application is a continuation of U.S. application Ser. No. 11/713,520 filed Mar. 7, 2006, now U.S. Pat. No. 8,062,503, which is a continuation of U.S. application Ser. No. 09/955,267, now U.S. Pat. No. 7,270,743, filed Sep. 18, 2001 and claims the benefit of U.S. Provisional Application No. Ser. No. 60/233,354, filed on Sep. 18, 2000, which applications are incorporated herein by reference.

FIELD OF THE INVENTION

The present invention relates to the rapid thermal processing of viscous oil feedstocks. More specifically, this invention relates to the use of pyrolysis in order to upgrade and reduce the viscosity of these oils.

BACKGROUND OF THE INVENTION

Heavy oil and bitumen resources are supplementing the decline in the production of conventional light and medium crude oil, and production form these resources is expected to dramatically increase. Pipeline expansion is expected to handle the increase in heavy oil production, however, the heavy oil must be treated in order to permit its transport by pipeline. Presently heavy oil and bitumen crudes are either made transportable by the addition of diluents or they are upgraded to synthetic crude. However, diluted crudes or upgraded synthetic crudes are significantly different from conventional crude oils. As a result, bitumen blends or synthetic crudes are not easily processed in conventional fluid catalytic cracking refineries. Therefore, in either case the refiner must be configured to handle either diluted or upgraded feedstocks.

Many heavy hydrocarbon feedstocks are also characterized as comprising significant amounts of BS&W (bottom sediment and water). Such feedstocks are not suitable for transportable by pipeline, or upgrading due to the sand, water and corrosive properties of the feedstock. Typically, feedstocks characterized as having less than 0.5 wt. % BS&W are transportable by pipeline, and those comprising greater amount of BS&W require some degree of processing and treatment to reduce the BS&W content prior to transport. Such processing may include storage to let the water and particulates settle, followed by heat treatment to drive of water and other components. However, these manipulations are expensive and time consuming. There is therefore a need within the art for an efficient method for upgrading feedstock comprising a significant BS&W content prior to transport or further processing of the feedstock.

Heavy oils and bitumens can be upgraded using a range of rapid processes including thermal (e.g., U.S. Pat. No. 4,490,234; U.S. Pat. No. 4,294,686; U.S. Pat. No. 4,161,442), hydrocracking (U.S. Pat. No. 4,252,634) visbreaking (U.S. Pat. No. 4,427,539; U.S. Pat. No. 4,569,753; U.S. Pat. No. 5,413,702) or catalytic cracking (U.S. Pat. No. 5,723,040; U.S. Pat. No. 5,662,868; U.S. Pat. No. 5,296,131; U.S. Pat. No. 4,985,136; U.S. Pat. No. 4,772,378; U.S. Pat. No. 4,668,378, U.S. Pat. No. 4,578,183) procedures. Several of these processes, such as visbreaking or catalytic cracking, utilize either inert or catalytic particulate contact materials within upflow or downflow reactors. Catalytic contact materials are for the most part zeolite based (see for example U.S. Pat. No. 5,723,040; U.S. Pat. No. 5,662,868; U.S. Pat. No. 5,296,131; U.S. Pat. No. 4,985,136; U.S. Pat. No. 4,772,378; U.S. Pat. No. 4,668,378, U.S. Pat. No. 4,578,183; U.S. Pat. No. 4,435,272; U.S. Pat. No. 4,263,128), while visbreaking is typically utilizes inert contact material (e.g., U.S. Pat. No. 4,427,539; U.S. Pat. No. 4,569,753), carbonaceous solids (e.g., U.S. Pat. No. 5,413,702), or inert kaolin solids (e.g., U.S. Pat. No. 4,569,753).

The use of fluid catalytic cracking (FCC), or other, units for the direct processing of bitumen feedstocks is known in the art. However, many compounds present within the crude feedstocks interfere with these processes by depositing on the contact material itself These feedstock contaminants include metals such as vanadium and nickel, coke precursors such as Conradson carbon and asphaltenes, and sulfur, and the deposit of these materials results in the requirement for extensive regeneration of the contact material. This is especially true for contact material employed with FCC processes as efficient cracking and proper temperature control of the process requires contact materials comprising little or no combustible deposit materials or metals that interfere with the catalytic process.

To reduce contamination of the catalytic material within catalytic cracking units, pretreatment of the feedstock via visbreaking (U.S. Pat. No. 5,413,702; U.S. Pat. No. 4,569,753; U.S. Pat. No. 4,427,539), thermal (U.S. Pat. No. 4,252,634; U.S. Pat. No. 4,161,442) or other processes, typically using FCC-like reactors, operating at temperatures below that required for cracking the feedstock (e.g, U.S. Pat. No. 4,980,045; U.S. Pat. No. 4,818,373 and U.S. Pat. No. 4,263,128;) have been suggested. These systems operate in series with FCC units and function as pre-treaters for FCC. These pretreatment processes are designed to remove contaminant materials from the feedstock, and operate under conditions that mitigate any cracking. This ensures that any upgrading and controlled cracking of the feedstock takes place within the FCC reactor under optimal conditions.

Several of these processes (e.g., U.S. Pat. No. 4,818,373; U.S. Pat. No. 4,427,539; U.S. Pat. No. 4,311,580; U.S. Pat. No. 4,232,514; U.S. Pat. No. 4,263,128;) have been specifically adapted to process "resids" (i.e., feedstocks produced from the fractional distillation of a whole crude oil) and bottom fractions, in order to optimize recovery from the initial feedstock supply. The disclosed processes for the recovery of resids, or bottom fractions, are physical and involve selective vaporization or fractional distillation of the feedstock with minimal or no chemical change of the feedstock. These processes are also combined with metals removal and provide feedstocks suitable for FCC processing. The selective vaporization of the resid takes place under non-cracking conditions, without any reduction in the viscosity of the feedstock components, and ensures that cracking occurs within an FCC reactor under controlled conditions. None of these approaches disclose the upgrading of feedstock within this pretreatment (i.e., metals and coke removal) process. Other processes for the thermal treatment of feedstocks involve hydrogen addition (hydrotreating), which results in some chemical change in the feedstock.

U.S. Pat. No. 4,294,686 discloses a steam distillation process in the presence of hydrogen for the pretreatment of feedstock for FCC processing. This document also indicates that this process may also be used to reduce the viscosity of the feedstock such that the feedstock may be suitable for transport within a pipeline. However, the use of short residence time reactors to produce a transportable feedstock is not disclosed.

There is a need within the art for a rapid and effective upgrading process of a heavy oil or bitumen feedstock that involves a partial chemical upgrade or mild cracking of the feedstock in order to obtain a product characterized in having a reduced viscosity over the starting material. Ideally this process would be able to accommodate feedstocks comprising significant amounts of BS&W. This product would be transportable for further processing and upgrading. Such a process would not involve any catalytic-cracking activity due to the known contamination of catalyst contact materials with components present in heavy oil or bitumen s feedstocks. The rapid and effective upgrading process would produce a product characterized in having reduced viscosity, reduced metal content, increased API, and an optimal product yield.

The present invention is directed to the upgrading of heavy hydrocarbon feedstocks, for example but not limited to heavy oil or bitumen feedstocks, that utilizes a short residence pyrolytic reactor operating under conditions that cracks and chemically upgrades the feedstock. The feedstock used within this process may comprise significant levels of BS&W and still be effectively processed, thereby increasing the efficiency of feedstock handling. The process of the present invention provides for the preparation of a partially upgraded feedstock exhibiting reduced viscosity and increased API gravity. The process described herein selectively removes metals, salts, water and nitrogen from the feedstock, while at the same time maximizes the liquid yield, and minimizing coke and gas production. Furthermore, this process reduces the viscosity of the feedstock to an extent which can permit pipeline transport of the feedstock without addition of diluents. The partially upgraded product optionally permits transport of the feedstock offsite, to locations better equipped to handle refining. Such facilities are typically located at a distance from the point where the crude feedstock is obtained.

SUMMARY OF THE INVENTION

The present invention relates to the rapid thermal processing of viscous oil feedstocks. More specifically, this invention relates to the use of pyrolysis in order to upgrade and reduce the viscosity of these oils.

According to the present invention there is provided a method for upgrading a heavy hydrocarbon feedstock comprising:

i) introducing a particulate heat carrier into an upflow reactor;

ii) introducing the heavy hydrocarbon feedstock into the upflow reactor at least one location above that of the particulate heat carrier so that a loading ratio of the particulate heat carrier to feedstock is from about 10:1 to about 200:1;

iii) allowing the heavy hydrocarbon feedstock to interact with the heat carrier with a residence time of less than about 1 second, to produce a product stream;

iv) separating the product stream from the particulate heat carrier;

v) regenerating the particulate heat carrier; and vi) collecting a gaseous and liquid product from the product stream, wherein the liquid product exhibits an increased API gravity, a reduced pour point, reduced viscosity and a reduced level of contaminants over that of said feedstock.

Preferably, the loading ratio of the method as outlined above is from about 20:1 to about 30:1.

This invention also includes the method as outlined above wherein the heavy hydrocarbon feedstock is either heavy oil or bitumen. Furthermore, the feedstock is pre-heated prior to its introduction into the upflow reactor.

The present invention also relates to the method as defined above, wherein the temperature of the upflow reactor is less than 750° C., wherein the residence time is from about 0.5 to about 2 seconds, and wherein the particulate heat carrier is silica sand.

This invention is also directed to the above method wherein the contaminants, including Conradson carbon (coke), BS&W, nickel and vanadium are removed from the feedstock or deposited onto the heat carrier The present invention also includes the method as defined above, wherein said product stream of a first pyrolysis run is separated into a lighter fraction and a heavier fraction, collecting the lighter fraction from the product stream, and recycling the heavier fraction back into the upflow reactor for further processing within a second pyrolysis run to produce a second product stream. Preferably, the further processing includes mixing the heavier fraction with the particulate heat carrier, wherein the temperature of the particulate heat carrier of the second pyrolysis run is at about, or above, that used in the processing of the feedstock within the first pyrolysis run. For example, the temperature of the heat carrier within the first pyrolysis run is from about 300° C. to about 590° C., and the temperature of the second pyrolysis run is from about 530° C. to about 700° C. The residence time of the second pyrolysis run is the same as, or longer than, the residence time of the first pyrolysis run. Furthermore, the heavier fraction may be added to unprocessed feedstock prior to being introduced into the upflow reactor for the second pyrolysis run.

The present invention is also directed to an upgraded heavy oil characterized by the following properties:

i) an API gravity from about 13 to about 23;

ii) a density from about 0.92 to about 0.98;

iii) a viscosity at 40° C. (cSt) from about 15 to about 300; and iv) a reduced Vanadium content of about 60 to about 100 ppm; and v) a reduced Nickel content of about 10 to about 50 ppm.

This invention also embraces an upgraded bitumen characterized by the following properties:

i) an API gravity from about 10 to about 21;

ii) a density from about 0.93 to about 1.0;

iii) a viscosity at 40° C. (cSt) from about 15 to about 300; and iv) a reduced Vanadium content of about 60 to about 100 ppm; and v) a reduced Nickel content of about 10 to about 50 ppm.

The present invention also pertains to a liquid product characterized in having at least one of the following properties:

i) less than 50% of the components evolving at temperatures above 538° C. during simulated distillation;

ii) from about 60% to about 95% of the product evolving below 538° during simulated distillation;

iii) from about 1.0% to about 10% of the liquid product evolving below 193° C.

during simulated distillation;

iv) from about 2% to about 6% of the liquid product evolving between 193-232° C. during simulated distillation;

v) from about 10% to about 25% of the liquid product evolving between 232-327° C. during simulated distillation;

vi) from about 6% to about 15% of the liquid product evolving between 327-360° C. during simulated distillation; and vii). from about 34.5% to about 60% of the liquid product evolving between 360-538° C. during simulated distillation.

The present invention embraces a vacuum gas oil (VGO) characterised with a measured analine point from about 110°

F. to about 130° F., and a calculated analine point from about 125° F. to about 170° F. Furthermore, the VGO may be further characterized by having a hydrocarbon profile comprising about 38% mono-aromatics.

The present invention also pertains to a method for upgrading a heavy hydrocarbon feedstock comprising:

i) introducing a particulate heat carrier into an upflow reactor;

ii) introducing a feedstock into the upflow reactor at least one location above that of the particulate heat carrier so that a loading ratio of the particulate heat carrier to the heavy hydrocarbon feedstock is from about 10:1 to about 200:1;

iii) allowing the feedstock to interact with the heat carrier with a residence time of less than about 1 second, to produce a product stream;

iv) separating the product stream from the particulate heat carrier;

v) regenerating the particulate heat carrier; and vi) collecting a gaseous and liquid product from the product stream, wherein the feedstock is obtained from the direct contact between the product stream and a heavy hydrocarbon feedstock, within a condenser.

The present invention addresses the need within the art for a rapid upgrading process of a heavy oil or bitumen feedstock involving a partial chemical upgrade or mild cracking of the feedstock. This product may, if desired, be transportable for further processing and upgrading. The process as described herein also reduces the levels of contaminants within feedstocks, thereby mitigating contamination of catalytic contact materials with components present in heavy oil or bitumen feedstocks. Furthermore, the vacuum gas oil fraction (VGO) of the liquid product of the present invention is a suitable feedstock for catalytic cracking purposes, and exhibits a unique hydrocarbon profile, including high levels of reactive compounds including mono-aromatics and thiophene aromatics. Mono-aromatics and thiophene aromatics have a plurality of side chains available for cracking, and provide high levels of conversion during catalytic cracking Furthermore, a range of heavy hydrocarbon feedstocks may be processed by the methods as described herein, including feedstocks comprising significant amounts of BS&W. Feedstocks comprising significant BS&W content are non-transportable due to their corrosive properties. Current practices for the treatment of feedstocks to decrease their BS&W content are time consuming and costly, and still require further processing or partial upgrading prior to transport. The methods described herein permit the use of feedstocks having a substantial BS&W component, and produce a liquid product that is partially upgraded and suitable for pipeline or other methods, of transport. The present invention therefore provides for earlier processing of feedstocks and reduces associated costs and processing times.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
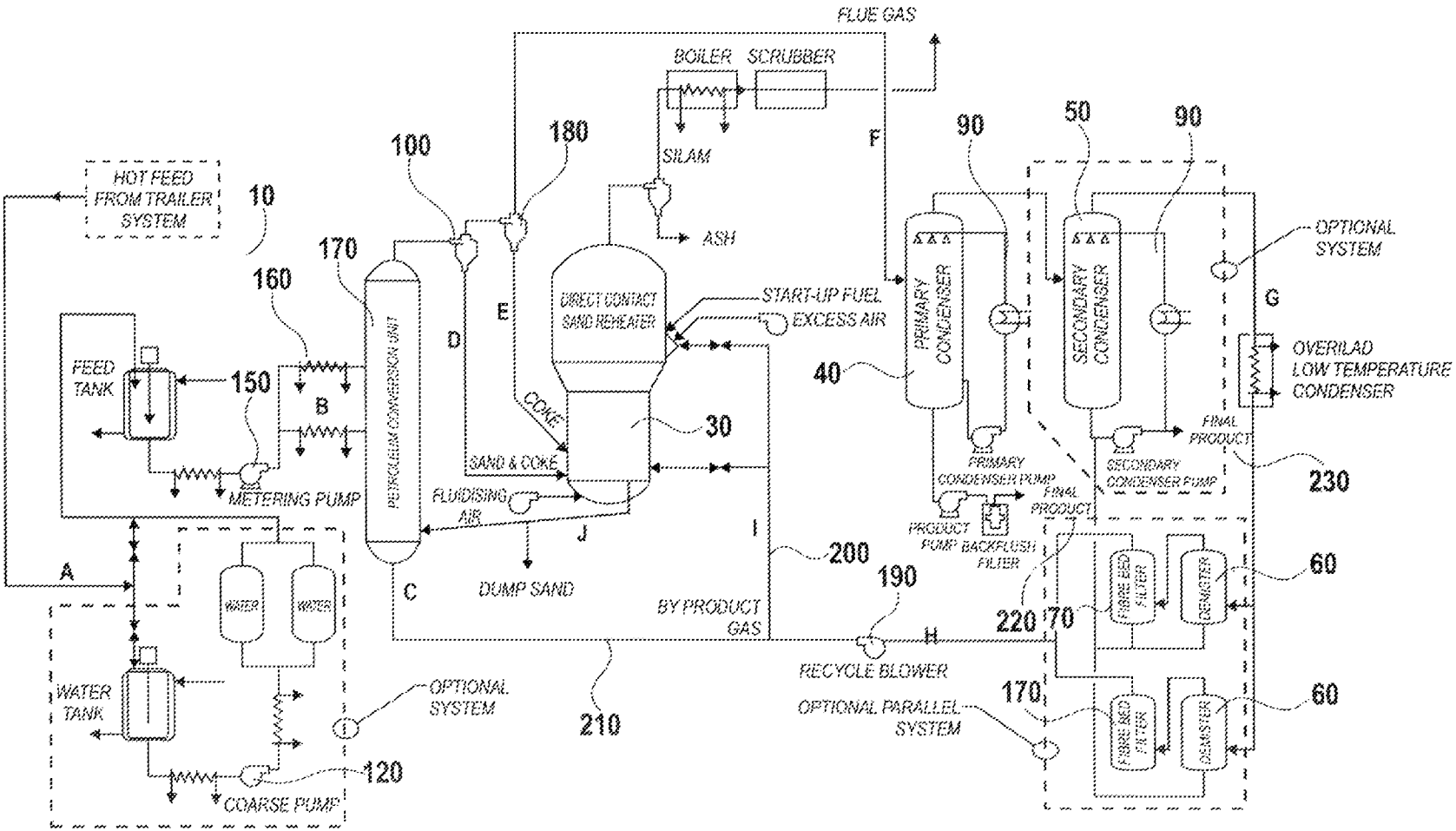
FIG. 1 is a schematic drawing of an embodiment of the present invention relating to a system for the pyrolytic processing of feedstocks.

The present invention relates to the rapid thermal processing of viscous crude oil feedstocks. More specifically, this invention relates to the use of pyrolysis in order to upgrade and reduce the viscosity of these oils.

The following description is of a preferred embodiment by way of example only and without limitation to the combination of features necessary for carrying the invention into effect.

By "feedstock" it is generally meant a heavy hydrocarbon feedstock comprising, but not limited to, heavy oil or bitumens. However, the term "feedstock" may also include other hydrocarbon compounds such as petroleum crude oil, atmospheric tar bottom products, vacuum tar bottoms, coal oils, residual oils, tar sands, shale oil and asphaltic fractions. Furthermore, the feedstock may comprise significant amounts of BS&W (Bottom Sediment and Water), for example, but not limited to, a BS&W content of greater than 0.5% (wt %). Feedstock may also include pre-treated (pre-processed) feedstocks as defined below, however, heavy oil and bitumen are the preferred feedstock. These heavy oil and bitumen feedstocks are typically viscous and difficult to transport. Bitumens typically comprise a large proportion of complex polynuclear hydrocarbons (asphaltenes) that add to the viscosity of this feedstock and some form of pretreatment of this feedstock is required for transport. Such pretreatment typically includes dilution in solvents prior to transport.

Typically tar-sand derived feedstocks (see Example 1 for an analysis of examples, which are not to be considered limiting, of such feedstocks) are pre-processed prior to upgrading, as described herein, in order to concentrate bitumen. However, pre-processing may also involve methods known within the art, including hot or cold water treatments, or solvent extraction that produces a bitumen-gas oil solution. These pre-processing treatments typically reduce the sand content of bitumen. For example one such water pre-processing treatment involves the formation of a tar-sand containing bitumen—hot water/NaOH slurry, from which the sand is permitted to settle, and more hot water is added to the floating bitumen to dilute out the base and ensure the removal of sand. Cold water processing involves crushing tar-sand in water and floating the bitumen containing tar-sands in fuel oil, then diluting the bitumen with solvent and separating the bitumen from the sand-water residue. A more complete description of the cold water process is disclosed in U.S. Pat. No. 4,818,373 (which is incorporated by reference). Such pre-processed or pre-treated feedstocks may also be used for further processing as described herein.

Bitumens may be upgraded using the process of this invention, or other processes such as FCC, visbraking, hydrocracking etc. Pre-treatment of tar sand feedstocks may also include hot or cold water treatments, for example, to partially remove the sand component prior to upgrading the feedstock using the process as described herein, or other upgrading processes including FCC, hydrocracking, coking, visbreaking etc. Therefore, it is to be understood that the term "feedstock" also includes pre-treated feedstocks, including, but not limited to those prepared as described above.

It is to be understood that lighter feedstocks may also be processed following the method of the invention as described herein. For example, and as described in more detail below, liquid products obtained from a first pyrolytic treatment as described herein, may be further processed by the method of this invention (for example composite recycle and multi stage processing; see FIG. 5 and Examples 3 and 4) to obtain a liquid product characterized as having reduced viscosity, a reduced metal (especially nickel, vanadium) and water content, and a greater API. Furthermore, liquid products obtained from other processes as known in the art, for example, but not limited to U.S. Pat. No. 5,662,868; U.S. Pat. No. 4,980,045; U.S. Pat. No. 5 4,818,373; U.S. Pat. No. 4,569,753; U.S. Pat. No. 4,435,272; U.S. Pat. No. 4,427,538; U.S. Pat. No. 4,427,539; U.S. Pat. No. 4,328,091; U.S. Pat. No. 4,311,580; U.S. Pat. No. 4,243,514; U.S. Pat. No. 4,294,686, may also be used as feedstocks for the process described herein. Therefore, the present invention also contemplates the use of lighter feedstocks including gas oils, vacuum gas oils, topped crudes or pre-processed liquid products, obtained from heavy oils or bitumens. These lighter feedstocks may be treated using the process of the present invention in order to upgrade these feedstocks for further processing using, for example, but not limited to, FCC, visbreaking, or hydrocracking etc, or for transport and further processing.

The liquid product arising from the process as described herein may be suitable for transport within a pipeline to permit further processing of the feedstock elsewhere. Typically, further processing occurs at a site distant from where the feedstock is obtained. However, it is considered within the scope of the present invention that the liquid product produced using the present method may also be directly input into a unit capable of further upgrading the feedstock, such as, but not limited to, FCC, coking, visbreaking, hydrocracking, or pyrolysis etc. In this capacity, the pyrolytic reactor of the present invention partially upgrades the feedstock while at the same time acts as a pre-treater of the feedstock for further processing, as disclosed in, for example, but not limited to U.S. Pat. No. 5,662,868; U.S. Pat. No. 4,980,045; U.S. Pat. No. 4,818,373; U.S. Pat. No. 4,569,753; U.S. Pat. No. 4,435,272; U.S. Pat. No. 4,427,538; U.S. Pat. No. 25 4,427,539; U.S. Pat. No. 4,328,091; U.S. Pat. No. 4,311,580; U.S. Pat. No. 4,243,514; U.S. Pat. No. 4,294,686 (all of which are incorporated by reference herein).

The feedstocks of the present invention are processed using a fast pyrolysis reactor, such as that disclosed in U.S. Pat. No. 5,792,340 (WO 91/11499; EP 513,051) involving contact times between the heat carrier and feedstock from about 0.01 to about 2 sec. Other known riser reactors with short residence times may also be employed, for example, but not limited to U.S. Pat. Nos. 4,427,539, 4,569,753, 4,818,373, 4,243,514 (which are incorporated by reference).

It is preferred that the heat carrier used within the pyrolysis reactor exhibits low catalytic activity. Such a heat carrier may be an inert particulate solid, preferably sand, for example silica sand. By silica sand it is meant a sand comprising greater than about 80% silica, preferably greater than about 95% silica, and more preferably greater than about 99% silica. Other components of the silica sand may include, but are not limited to, from about 0.01% (about 100 ppm) to about 0.04% (400 ppm) iron oxide, preferably about 0.035% (358 ppm); about 0.00037% (3.78 ppm) potassium oxide; about 0.00688% (68.88 ppm) aluminum oxide; about 0.0027 (27.25) magnesium oxide; and about 0.0051% (51.14 ppm) calcium oxide. It is to be understood that the above composition is an example of a silica sand that can be used as a heat carrier as described herein, however, variations within the proportions of these ingredients within other silica sands may exist and still be suitable for use as a heat carrier. Other known inert particulate heat carriers or contact materials, for example kaolin clays, rutile, low surface area alumina, oxides of magnesium aluminum and calcium as described in U.S. Pat. No. 4,818,373 or U.S. Pat. No. 4,243,514, may also be used.

Processing of feedstocks using fast pyrolysis results in the production of product vapours and solid byproducts associated with the heat carrier. After removal of the heat carrier from the product stream, the product vapours are condensed to obtain a liquid product and gaseous by-products. For example, which is not to be considered limiting, the liquid product produced from the processing of heavy oil, as described herein, is characterized in having the following properties:

- a boiling point of less than about 60° C., preferably less than about 525° C., and more preferably less than about 500° C.;
- an API gravity of at least about 12°, and preferably greater than about 17° (where API gravity=[141.5/specific gravity]−131.5; the higher the API gravity, the lighter the compound);
- greatly reduce metals content, including V and NI;
- greatly reduced viscosity levels (more than 25 fold lower than that of the feedstock, for example, as determined @ 40° C.), and
- yields of liquid product of at least 60 vol %, preferably the yields are greater than about 70 vol %, and more preferably they are greater s than about 80%.

Following the methods as described herein, a liquid product obtained from processing bitumen feedstock, which is not to be considered limiting, is characterized as having:

- an API gravity from about 10 to about 21;
- a density @ 15° C. from about 0.93 to about 1.0;
- greatly reduce metals content, including V and Ni;
- a greatly reduced viscosity of more than 20 fold lower than the feedstock (for example as determined at 40° C.), and
- yields of liquid product of at least 60 vol %, preferably the yields are greater than about 75 vol %.

The high yields and reduced viscosity of the liquid product produced according to this invention may permit the liquid product to be transported by pipeline to refineries for further processing with the addition of little or no diluents. Furthermore, the liquid products exhibit reduced levels of contaminants (e.g., metals and water), with the content of sulphur and nitrogen slightly reduced. Therefore, the liquid product may also be used as a feedstock, either directly, or following transport, for further processing using, for example, FCC, hydrocracking etc.

Furthermore, the liquid products of the present invention may be characterised using Simulated Distillation (SimDist) analysis, as is commonly known in the art, for example but not limited to ASTM D 5307-97 or HT 750 (NCUT). SimDist analysis, indicates that liquid products obtained following processing of heavy oil or bitumen can be characterized by any one of, or a combination of, the following properties (see Examples 1, 2 and 5):

- having less than 50% of their components evolving at temperatures above 538° C. (vacuum resid fraction);
- comprising from about 60% to about 95% of the product evolving below 538°. Preferably, from about 62% to about 85% of the product evolves during SimDist below 538° C. (i.e., before the vacuum resid. fraction);

having from about 1.0% to about 10% of the liquid product evolve below 193° C. Preferably from about 1.2% to about 6.5% evolves below 193° C. (i.e., before the naphtha/kerosene fraction);

having from about 2% to about 6% of the liquid product evolve between 193-232° C. Preferably from about 2.5% to about 5% evolves between 193-232° C. (kerosene fraction);

having from about 10% to about 25% of the liquid product evolve between 232-327° C. Preferably, from about 13 to about 24% evolves is between 232-327° C. (diesel fraction);

having from about 6% to about 15% of the liquid product evolve between 327-360° C. Preferably, from about 6.5 to about 11% evolves between 327-360° C. (light vacuum gas oil (VGO) fraction);

having from about 34.5% to about 60% of the liquid product evolve between 360-538° C. Preferably, from about 35 to about 55% evolves between 360-538° C. (Heavy VGO fraction);

The vacuum gas oil (VGO) fraction produced as a distilled fraction obtained from the liquid product of rapid thermal processing as described herein, may be used as a feedstock for catalytic cracking in order to covert the heavy compounds of the VGO to a range of lighter weight compounds for example, gases ($C_4$ and lighter), gasoline, light cracked oil, and heavy gas oil. The quality and characteristics of the VGO fraction may be analysed using standard methods known in the art, for example Microactivity testing (MAT) testing, K-factor and analine point analysis. Analine point analysis determines the minimum temperature for complete miscibility of equal volumes of analine and the sample under test. Determination of analine point for petroleum products and hydrocarbon solvents is typically carried out using ASTM Method D611. A product characterized with a high analine point is low in aromatics, naphthenes, and high in paraffins (higher molecular weight components). VGOs of the prior art, are characterized as having low analine points and therefore have poor cracking characteristics are undesired as feedstocks for catalytic cracking Any increase in analine point over prior art feedstocks is beneficial, and it is desired within the art to have a VGO characterized with a high analine point. Typically, analine points correlate well with cracking characteristics of a feed, and the calculated analine points obtained from MAT. However, the observed analine points for the VGOs produced according to the procedure described herein do not conform with this expectation. The estimated analine points for several feedstocks is higher than that as measured (see example 6; Tables 16 and 17). This indicates that the VGOs produced using the method of the present invention are unique compared to prior art VGOs. Furthermore, VGOs of the present invention are characterized by having a unique hydrocarbon profile comprising about 38% mono-aromatics plus thiophene aromatics. These types of molecules have a plurality of side chains available for cracking, and provide higher levels of conversion, than compounds with reduced levels of mono-aromatics and thiophene aromatic compounds, typical of the prior art. Without wishing to be bound by theory, the increased amounts of mono-aromatic and thiophene aromatic may result in the discrepancy between the catalytic cracking properties observed in MAT testing and the determined analine point.

VGO s obtained from heavy hydrocarbon feedstocks, produced as described herein, are characterized as having an analine point of about 110° F. to about 170° F. depending upon the feedstock. For example, using Athabaska bitumen as a feedstock, the VGO exhibits an analine point of from about 100° to about 135° F., VGO obtained from Athabaska resid exhibits an analine point of about 148° F., while the VGO obtained from Kerrobert heavy crude is from about 119° to about 158° F. If the VGO is hydrotreated, for example Athabaskan bitumen VGO, using standard methods known in the art, for example, using a reactor at about 720° F., running at 1500 psig, with a space velocity of 0.5, and a hydrogen rate of 3625 SCFB, the analine point increases from about 1330 to about to about 158°. Similar hydrotreating of an Athabaska-VGO resid increase the analine point to about 170° F. With hydrotreating, the API increases, for example, from about 14.2 (for ATB-VGO) to about 22.4 (for Hydro-ATB-VGO), or from about 11.8 (for ATB-VGO resid) to about 20 (for Hydro-ATB-VGO resid), with a decrease in the sulfur level from about 3.7 wt % to about 0.27 wt % (for ATB-VGO and Hydro-ATB-VGO, respectively; see Example 6).

Figure 2:
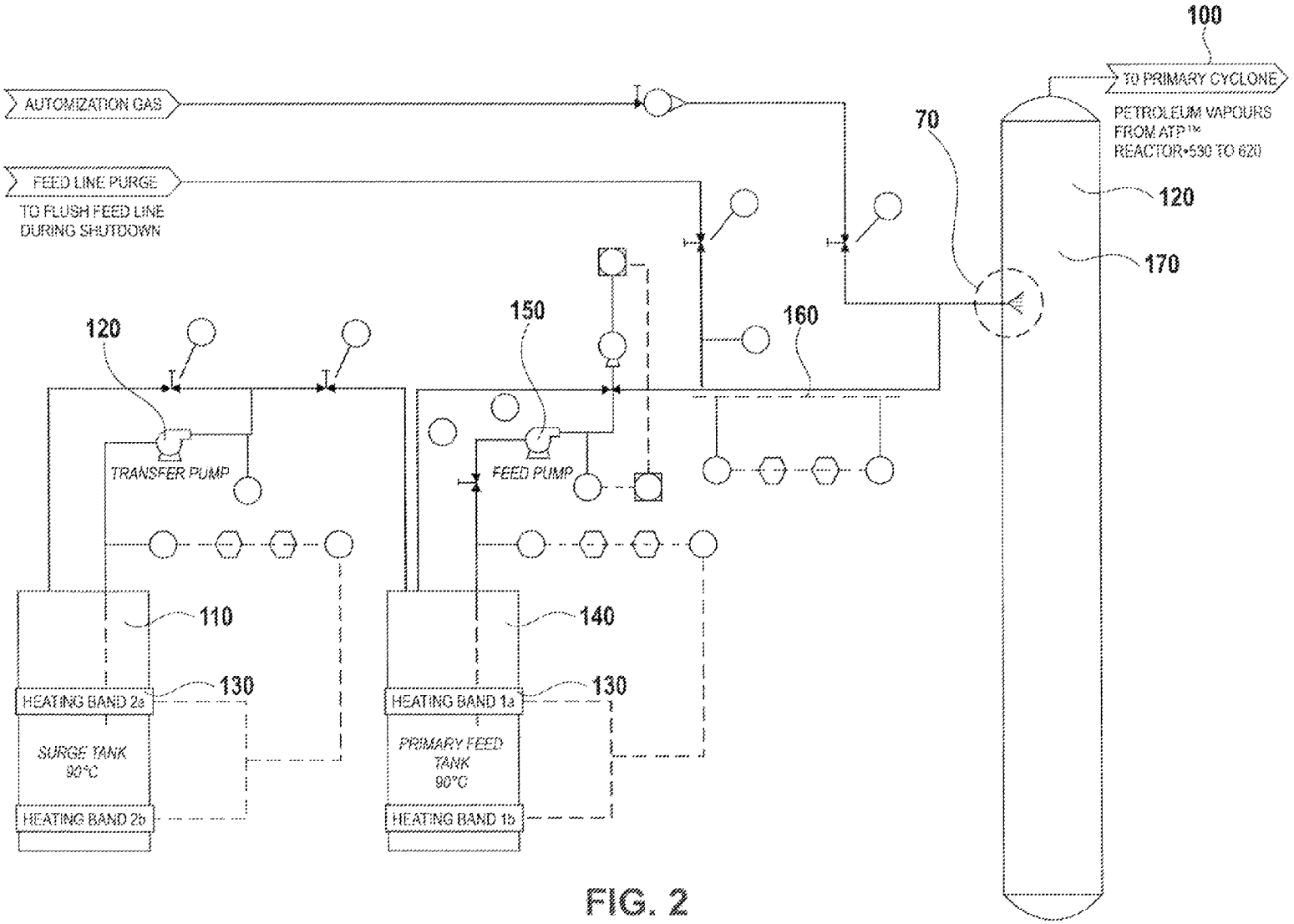
FIG. 2 is a schematic drawing of an embodiment of the present invention relating to the feed system for introducing the feedstock to the system for the pyrolytic processing of feedstocks.

A first method for upgrading a feedstock to obtain liquid products with desired properties involves a one stage process. With reference to FIG. 1, briefly, the fast pyrolysis system includes a feed system generally indicated as (10; also see FIGS. 2 and 3), that injects the feedstock into a reactor (20), a heat carrier separation system that separates the heat carrier from the product vapour (e.g., 100 and 180) and recycles the heat carrier to the reheating/regenerating system (30), a particulate inorganic heat carrier reheating system (30) that reheats and regenerates the heat carrier, and primary (40) and secondary (50) condensers that collect the product. The preheated feedstock enters the reactor just below the mixing zone (170) and is contacted by the upward flowing stream of hot inert carrier within a transport fluid, typically a recycle gas supplied by a recycle gas line (210). A through and rapid mixing and conductive heat transfer from the heat carrier to the feedstock takes place in the short residence time conversion section of the reactor. The feedstock may enter the reactor through at least one of several locations along the length of the reactor. The different entry points indicated in FIGS. 1 and 2 are non-limiting examples of such entry locations. By providing several entry points along the length of the reactor, the length of the residence time within the reactor may be varied. For example, for longer residence times, the feedstock enters the reactor at a location lower down the reactor, while, for shorter residence times, the feedstock enters the reactor at a location higher up the reactor. In all of these cases, the introduced feedstock mixes with the upflowing heat carrier within a mixing zone (170) of the reactor. The product vapours produced during pyrolysis are cooled and collected using a suitable condenser means (40, 50) in order to obtain a liquid product.

It is to be understood that other fast pyrolysis systems, comprising differences in reactor design, that utilize alternative heat carriers, heat carrier separators, different numbers or size of condensers, or different condensing means, may be used for the preparation of the upgraded product of this invention. For example, which is not to be considered limiting, reactors disclosed in U.S. Pat. Nos. 4,427,539, 4,569,753, 4,818,373, 4,243,514 (all of which are incorporated by reference) may be modified to operate under the conditions as outlined herein for the production of a chemically upgraded product with an increased API and reduced viscosity.

Following pyrolysis of the feedstock in the presence of the inert heat carrier, some contaminants present within the feedstock are deposited onto the inert heat carrier. These contaminants include metals (especially nickel and vanadium), coke, and to some extent nitrogen and sulphur. The inert heat carrier therefore requires regeneration (30) before re-introduction into the reaction stream. The heat carrier may be regenerated via combustion within a fluidized bed at a temperature of about 600 to about 900° C. Furthermore, as required, deposits may also be removed from the heat carrier by an acid treatment, for example as disclosed in U.S. Pat. No. 4,818,373 (which is incorporated by reference). The heated, regenerated, heat-carrier is then reintroduced to the reactor (20) and acts as heat carrier for fast pyrolysis.

Figure 5:
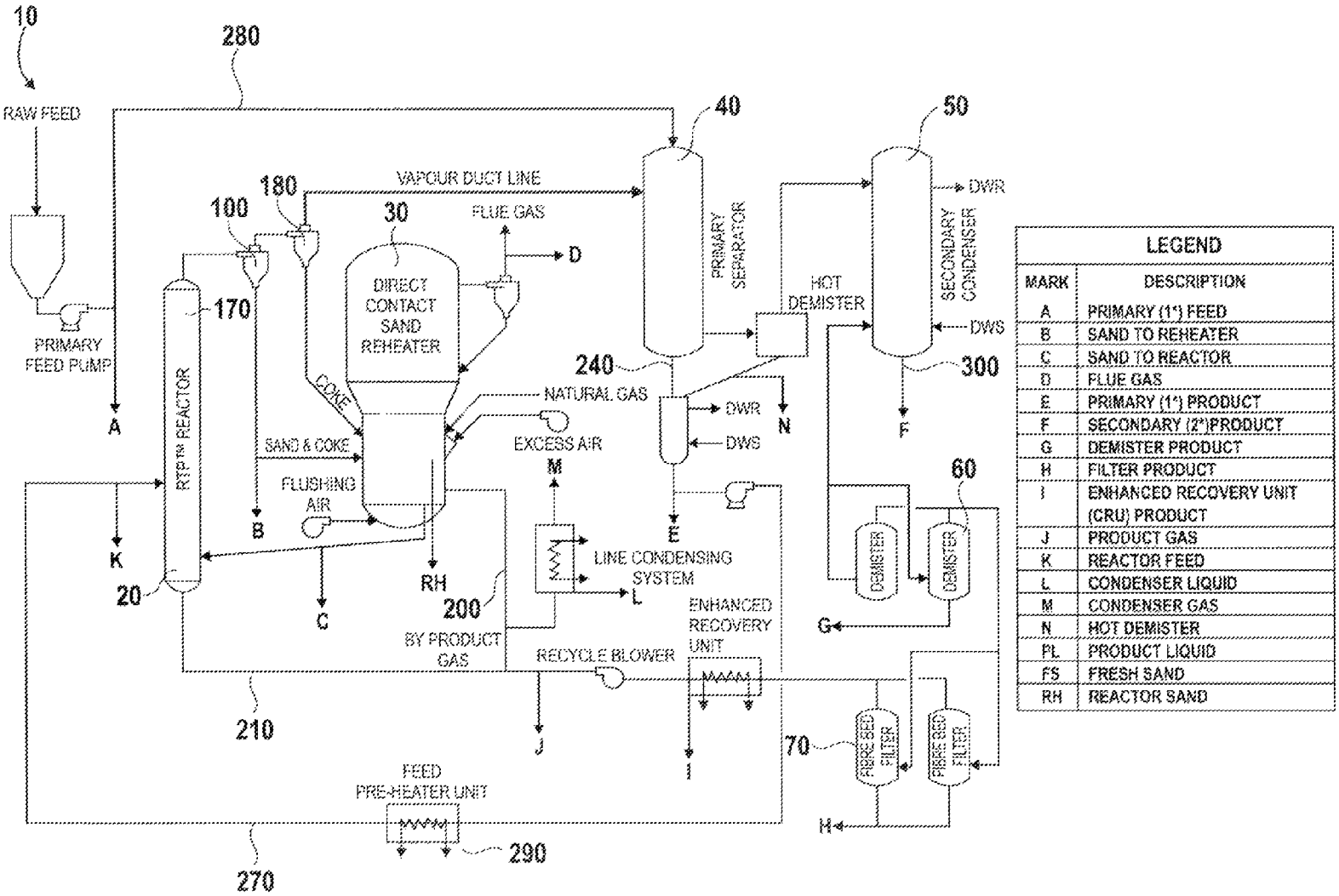
FIG. 5 is a schematic drawing of an embodiment of the present invention relating to a multi stage system for the pyrolytic processing of feedstocks.

The feed system (10) provides a preheated feedstock to the reactor (20). An example of a feed system which is not to be considered limiting in any manner, is shown in FIG. 2, however, other embodiments of the feed system are within the scope of the present invention, for example but not limited to a feed pre-heater unit as shown in FIG. 5 (discussed below) and may be optionally used in conjunction with a feed system (10; FIG. 5). The feed system (generally shown as 10, FIGS. 1 and 2) is designed to provide a regulated flow of pre-heated feedstock to the reactor unit (20). The feed system shown in FIG. 2 includes a feedstock pre-heating surge tank (110), heated using external band heaters (130) to 80° C., and is associated with a recirculation/transfer pump (120). The feedstock is constantly heated and mixed in this tank at 80° C. The hot feedstock is pumped from the surge tank to a primary feed tank (140), also heated using external band heaters (130), as required. However, it is to be understood that variations on the feed system may also be employed, in order to provide a heated feedstock to the reactor. The primary feed tank (140) may also be fitted with a recirculation/delivery pump (150). Heat traced transfer lines (160) are maintained at about 150° C. and pre-heat the feedstock prior to entry into the reactor via an injection nozzle (170). Atomization at the injection nozzle (70) positioned near the mixing zone (170) within reactor (20) may be accomplished by any suitable means. The nozzle arrangement should provide for a homogeneous dispersed flow of material into the reactor. For example, which is not considered limiting in any manner, mechanical pressure using single-phase flow atomization, or a two-phase flow atomization nozzle may be used. With a two-phase flow atomization nozzle, pre-heated air, nitrogen or recycled by-product gas may be used as a carrier. Instrumentation is also dispersed throughout this system for precise feedback control (e.g., pressure transmitters, temperature sensors, DC controllers, 3-way valves gas flow meters etc.) of the system.

Conversion of the feedstock is initiated in the mixing zone (170: e.g., FIG. 1) under moderate temperatures (typically less than 750° C.) and continues through the conversion section within the reactor unit (20) and connections (e.g., piping, duct work) up until the primary separation system (e.g., 100) where the bulk of the heat carrier is removed from the product vapour stream. The solid heat carrier and solid coke by-product are removed from the product vapour stream in a primary separation unit. Preferably, the product vapour stream is separated from the heat carrier as quickly as possible after exiting from the reactor (20), so that the residence time of the product vapour stream in the presence of the heat carrier is as short us possible.

The primary separation unit may be any suitable solids separation device, for example but not limited to a cyclone separator, a U-Beam separator, or Rams Horn separator as are known within the art. A cyclone separator is shown diagrammatically in FIGS. 1, 3 and 4. The solids separator, for example a primary cyclone (100), is preferably fitted with a high-abrasion resistant liner. Any solids that avoid collection in the primary collection system are carried downstream and recovered in a secondary collection system (ISO). The secondary s separation unit may be the same as the primary separation unit, or it may comprise an alternate solids separation device, for example but not limited to a cyclone separator, a ¼ turn separator, for example a Rams Horn separator, or an impingement separator, as are known within the art. A secondary cyclone separator (180) is graphically represented in FIGS. 1 and 4, however, other separators may be used as a secondary separator unit.

The solids that have been removed in the primary and secondary collection systems are transferred to a vessel for regeneration of the heat carrier, for example, but not limited to a direct contact reheater system (30). In a direct contact reheater system (30), the coke and by-product gasses are oxidized to provide processes thermal energy which is directly carried to the solid heat carrier, as well as regenerating the heat carrier. The temperature of the direct contact reheater is maintained independent of the feedstock conversion (reactor) system. However, as indicated above, other methods for the regeneration of the heat carrier may be employed, for example but not limited to, acid treatment.

The hot product stream from the secondary separation unit is quenched in a primary collection column (or primary condenser, 40; FIG. 1). The vapour stream is rapidly cooled from the conversion temperature to less than about 400° C. Preferably the vapour stream is cooled to about 300° C. Product is drawn from the primary column and pumped (220) into product storage tanks A secondary condenser (50) can be used to collect any material that evades the primary condenser (40). Product drawn from the secondary condenser (50) is also pumped (230) into product storage tanks. The remaining non-condensible gas is compressed in a blower (190) and a portion is returned to the heat carrier regeneration system (30) via line (200), and the remaining gas is returned to the reactor (20) by line (210) and acts as a heat carrier, and transport, medium.

It is preferred that the reactor used with the process of the present invention is capable of producing high yields of liquid product for example at least greater than 60 vol %, preferably the yield is greater than 70 vol %, and more preferably the yield is greater than 80%, with minimal byproduct production such as coke and gas. Without wishing to limit the scope of the invention in any manner, an example for the suitable conditions for a the pyrolytic treatment of feedstock, and the production of a liquid product is described in U.S. Pat. No. 5,792,340, which is incorporated herein by reference. This process utilizes sand (silica sand) as the heat carrier, and a reactor temperature ranging from about 480° to about 620° C., loading ratios of heat carrier to feedstock from about 10:1 to about 200:1, and residence times from about 0.35 to about 0.7 sec. Preferably the reactor temperature ranges from about 500° to about 550° C. The preferred loading ratio is from about 15:1 to about 50:1, with a more preferred ratio from about 20:1 to about 30:1. Furthermore, it is to be understood that longer residence times within the reactor, for example up to about 5 sec, may be obtained if desired by introducing the feedstock within the reactor at a position towards the base of the reactor, by increasing the length of the reactor itself, by reducing the velocity of the heat carrier through the reactor (provided that there is sufficient velocity for the product vapour and heat carrier to exit the reactor), or a combination thereof. The preferred residence time is from about 0.5 to about 2 sec.

Without wishing to be bound by theory, it is thought that the chemical upgrading of the feedstock that takes place within the reactor system as described above is in part due to the high loading ratios of feedstock to heat carrier that are used within the method of the present invention. Prior art loading ratios typically ranged from 5:1 to about 12.5:1. However, the loading ratios as described herein, of from about 15:1 to about 200:1, result in a very rapid, ablative and consistent transfer of heat from the heat carrier to the feedstock. The high volume and density of heat carrier within the mixing and conversion zones, ensures that a rapid and even processing temperature is achieved and maintained. In this way the temperatures required for cracking process described herein are easily controlled. This also allows for the use of relatively low temperatures to minimize over cracking, while ensuring that mild cracking of the feedstock is still achieved. Furthermore, with an increased density of heat carrier within the reactor, contaminants and undesired components present in the feedstock and reaction by-products, including metals (e.g., nickel and vanadium), coke, and to some extent s nitrogen and sulphur, are readily adsorbed due to the large surface area of heat carrier present. This ensures efficient and optimal removal of contaminants from the feedstock, during the pyrolytic processing of the feedstock. As a larger surface area of heat carrier is employed, the heat carrier itself is not unduly contaminated, and any adsorbed metal or coke and the like is readily stripped during regeneration of the heat carrier. With this system the residence times can be carefully regulated in order to optimize the processing of the feedstock and liquid product yields.

The liquid product arising from the processing of heavy oil as described herein has significant conversion of the resid fraction when compared to heavy oil or bitumen feedstock. As a result the liquid product of the present invention, is produced from the processing of heavy oil is characterized, for example, but which is not to be considered limiting, as having an API gravity of at least about 13°, and more preferably of at least about 17°. However, as indicated above, higher API gravities may be achieved with a reduction in volume. For example, one liquid product obtained from the processing of heavy oil using the method of the present invention is characterized as having from about 10 to about 15% by volume bottoms, from about 10 to about 15% by volume light ends, with the remainder as middle distillates.

The viscosity of the liquid product produced from heavy oil is substantially reduced from initial feedstock levels, of from 250 cSt @ 80° C., to product levels of 4.5 to about 10 cSt @ 80° C., or from about 6343 cSt @ 40° C., in the feedstock, to about 1.5 to about 35 cSt @40° C. in the liquid product. Following a single stage process, liquid yields of greater than 80 vol % and API gravities of about 17, with viscosity reductions of at least about 25 times that of the feedstock are obtained (@40° C.). These viscosity levels are suitable for pipeline transport of the liquid product. Results from Simulated Distillation (SiniDist; e.g., ASTM D 5307-97, HT 750, (NCUT)) analysis further reveals substantially different properties between the feedstock and liquid product as produced herein. For heavy oil feedstock, approx. 1% (wt %) of the feedstock is distilled off below about 232° C. (Kerosene fraction), approx. 8.7% from about 232° to about 327° C. (Diesel fraction), and 51.5% evolved above 538° C. (Vacuum resid fraction; see Example 1 for complete analysis). SimDist analysis of the liquid product produced as described above may be characterized as having, but is not limited to having, the following properties: approx. 4% (wt %) evolving below about 232° C. (Kerosene fraction), approx. 14.2% from about 232° to about 327° C. (Diesel fraction), and 37.9% within the vacuum resid fraction (above 538° C.). It is to be understood that modifications to these values may arise depending upon the composition of the feedstock used. These results demonstrate that there is a significant alteration in many of the components within the liquid product when compared with the heavy oil feedstock, with a general trend to lower molecular weight components that evolve earlier during SimDist analysis following rapid thermal processing.

Therefore, the present invention is directed to a liquid product obtained from single stage processing of heavy oil may that may be characterised by at least one of the following properties:

- having less than 50% of their components evolving at temperatures above 538° C. (vacuum resid fraction);
- comprising from about 60% to about 95% of the product evolving below 538°. Preferably, from about 60% to about 80% evolves during Simulated Distillation below 538° C. (i.e., before the vacuum resid. fraction);
- having from about 1.0% to about 6% of the liquid product evolve below 193° C. Preferably from about 1.2% to about 5% evolves below 193° C. (i.e., before the naphtha/kerosene fraction);
- having from about 2% to about 6% of the liquid product evolve between 193-232° C. Preferably from about 2.8% to about 5% evolves between 193-232° C. (diesel fraction);
- having from about 12% to about 25% of the liquid product evolve between 232-327° C. Preferably, from about 13 to about 18% evolves between 232-327° C. (diesel fraction);
- having from about 5% to about 10% of the liquid product evolve between 327-360° C. Preferably, from about 6.0 to about 8.0% evolves between 327-360° C. (light VGO fraction);
- having from about 40% to about 60% of the liquid product evolve between 360-538° C. Preferably, from about 30 to about 45% evolves between 360-538° C. (Heavy VGO fraction).

Similarly following the methods as described herein, a liquid product obtained from processing bitumen feedstock following a single stage process, is characterized as having, and which is not to be considered as limiting, an increase in API gravity of at least about 10 (feedstock API is typically about 8.6). Again, higher API gravities may be achieved with a reduction in volume. The product obtained from bitumen is also characterised as having a density from about 0.93 to about 1.0 and a greatly reduced viscosity of at least about 20 fold lower than the feedstock (i.e., from about 15 g/ml to about 60 g/ml at 40° C. in the product, v. the feedstock comprising about 1500 g/ml). Yields of liquid product obtained from bitumen are at least 60% by vol, and preferably greater than about 75% by vol. SimDist analysis also demonstrates significantly different properties between the bitumen feedstock and liquid product as produced herein. Highlights from SimDist analysis indicates that for a bitumen feedstock, approx. 1% (wt %) of the feedstock was distilled off below about 232° C. (Kerosene fraction), approx. 8.6% from about 232° to about 327° C. (Diesel fraction), and 51.2% evolved above 538° C. (Vacuum resid fraction; see Example 2 for complete analysis). SimDist analysis of the liquid product produced from bitumen as described above may be characterized, but is not limited to the following properties: approx. 5.7% (wt %) is evolved below about 232° C. (Kerosene fraction), approx. 14.8% from about 232° to about 327° C. (Diesel fraction), and 29.9% within the vacuum resid fraction (above 538° C.). Again, these results may differ depending upon the feedstock used, however, they demonstrate the significant alteration in many of the components within the liquid product when compared with the bitumen feedstock, and the general trend to lower molecular weight components that evolve earlier during SimDist analysis in the liquid product produced from rapid thermal processing.

Therefore, the present invention is also directed to a liquid product obtained from single stage processing of bitumen, which is characterised by having at least one of the following properties:

- having less than 50% of their components evolving at temperatures above 538° C. (vacuum resid fraction);
- comprising from about 60% to about 95% of the product evolving below 538°. Preferably, from about 60% to about 80% evolves during Simulated Distillation below 538° C. (i.e., before the vacuum resid. fraction);
- having from about 1.0% to about 6% of the liquid product evolve below 193° C. Preferably from about 1.2% to about 5% evolves below 193° C. (i.e., before the naphtha/kerosene fraction);
- having from about 2% to about 6% of the liquid product evolve between 193-232° C. Preferably from about 2.0% to about 5% evolves between 193-232° C. (diesel fraction);
- having from about 12% to about 25% of the liquid product evolve between 232-327° C. Preferably, from about 13 to about 18% evolves between 232-327° C. (diesel fraction);
- having from about 5% to about 10% of the liquid product evolve between 327-360° C. Preferably, from about 6.0 to about 8.0% evolves between 327-360° C. (light VGO fraction);
- having from about 40% to about 60% of the liquid product evolve between 360-538° C. Preferably, from about 30 to about 50% evolves between 360-538° C. (Heavy VGO fraction).

The liquid product produced as described herein also exhibits a high degree of stability. Analysis of the liquid product over a 30-day period indicates negligible change in SimDist profile, viscosity, API and density for liquid products produced from either heavy oil or bitumen feedstocks (see Example 1 and 2).

Because the crack is not as severe, and the residence time short, unwanted reactions that can generate excessive amounts of undesirable aromatics and olefins. Furthermore, it has been found that contaminants such as metals. and water are significantly reduced. There is no concentration of contaminants in the liquid product.

Also as disclosed herein, further processing of the liquid product obtained from the process of heavy oil or bitumen feedstock may take place following the method of this invention. Such further processing may utilize conditions that are very similar to the initial fast pyrolysis treatment of the feedstock, or the conditions may be modified to enhance removal of lighter products (a single-stage process with a mild crack) followed by more severe cracking of the recycled fraction (i.e., a two stage process).

In the first instance, that of further processing under similar conditions the liquid product from a first pyrolytic treatment is recycled back into the pyrolysis reactor in order to further upgrade the properties of the final product to produce a lighter product. In this arrangement the liquid product from the first round of pyrolysis is used as a feedstock for a second round of pyrolysis after the lighter fraction of the product has been removed from the product stream. Furthermore, a composite recycle may also be carried out where the heavy fraction of the product stream of the first process is fed back (recycled) into the reactor along with the addition of fresh feedstock (e.g., FIG. 3, described in more detail below).

Figure 3:
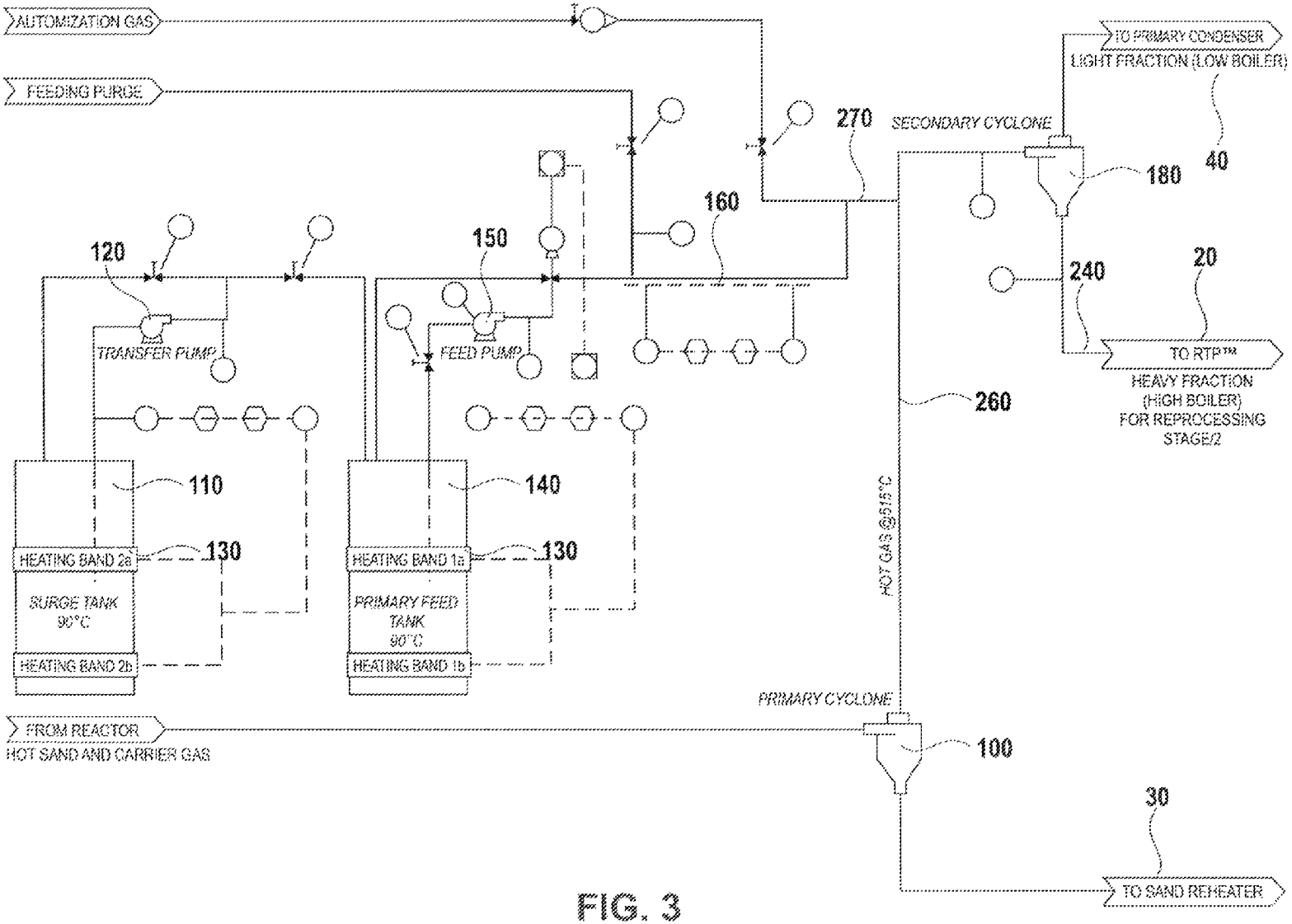
FIG. 3 is a schematic drawing of an embodiment of the present invention relating to the feed system for introducing feedstock into the second stage of a two stage process using the system for the pyrolytic processing of feedstocks as described herein.
Figure 4:
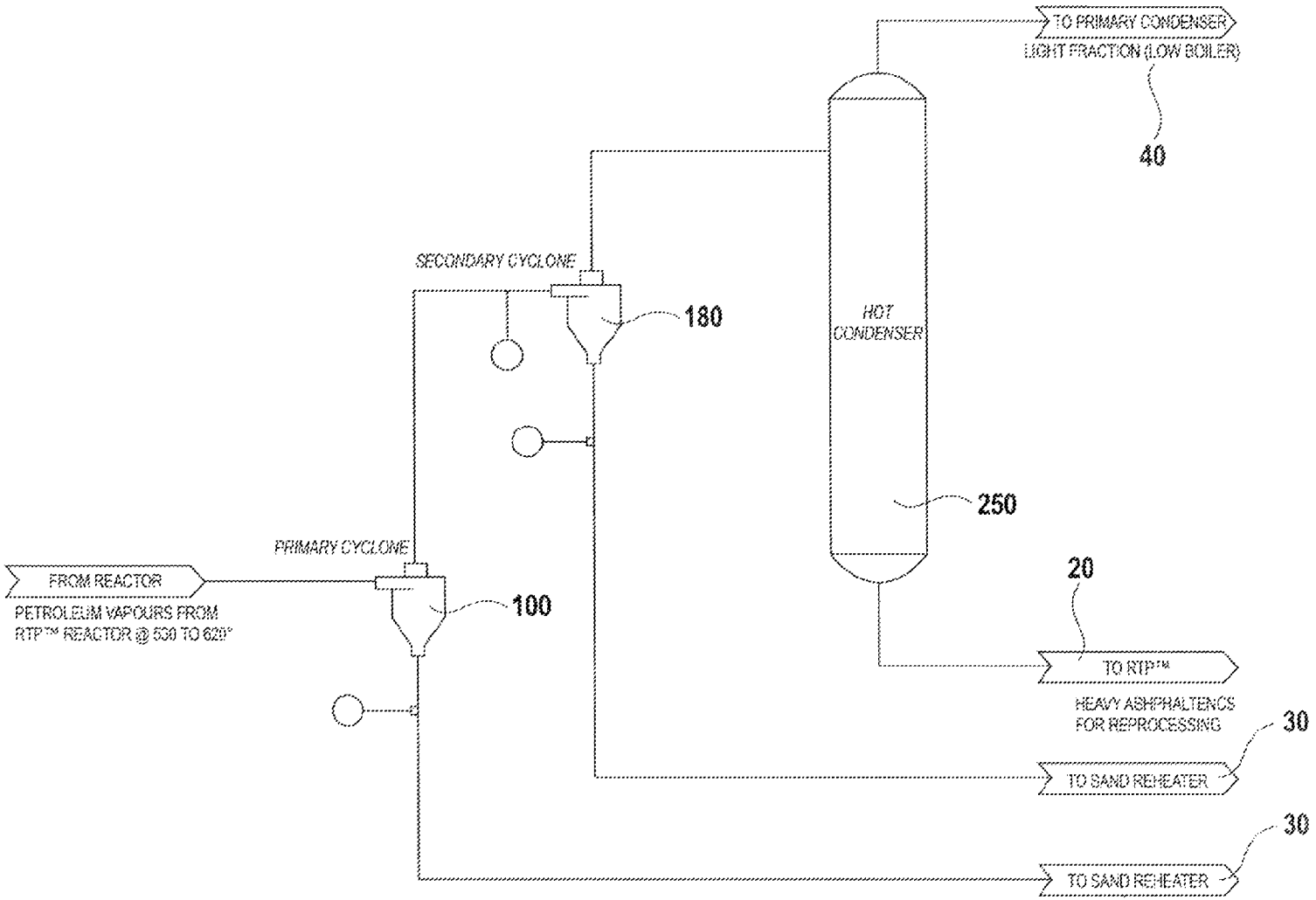
FIG. 4 is a schematic drawing of an embodiment of the present invention relating to the recovery system for obtaining feedstock to be either collected from a primary condenser, or recycled to the second stage of a two stage process using the system for the pyrolytic processing of feedstocks as described herein.

The second method for upgrading a feedstock to obtain liquid products with desired properties involves a two-stage pyrolytic process (see FIGS. 2 and 3). This two stage processes comprises a first stage where the feedstock is exposed to conditions that mildly cracks the hydrocarbon components in order to avoid overcracking and excess gas and coke production. An example of these conditions includes, but is not limited to, injecting the feedstock at about 150° C. into a hot gas stream comprising the heat carrier at the inlet of the reactor. The feedstock is processed with a residence time less than about one second within the reactor at less than 500° C., for example 300° C. The product, comprising lighter materials (low boilers) is separated (100, and 180, FIG. 3), and removed following the first stage in the condensing system (40). The heavier materials (240), separated out at the bottom of the condenser (40) are collected subjected to a more severe crack within the reactor (20) in order to render a liquid product of reduced viscosity and high yield. The conditions utilized in the second stage include, but are not limited to, a processing temperature of about 530° to about 590° C. Product from the second stage is processed and collected as outlined in FIG. 1 using a primary and secondary cyclone (100, 180, respectively) and primary and secondary condensers (40 and 50, respectively).

Following such a two stage process, an example of the product, which is not to be considered limiting, of the first stage (light boilers) is characterized with a yield of about 30 vol %, an API of about 19, and a several fold reduction in viscosity over the initial feedstock. The product of the high boiler fraction, produced following the processing of the recycle fraction in the second stage, is typically characterized with a yield greater than about 75 vol %, and an API gravity of about 12, and a reduced viscosity over the feedstock recycled fraction. SimDist analysis for liquid product produced from heavy oil feedstock is characterized with approx. 7.4% (wt %) of the feedstock was distilled off below about 232° C. (Kerosene fraction v. 1.1% for the feedstock), approx. 18.9% from about 232° to about 327° C. (Diesel fraction v. 8.7% for the feedstock), and 21.7% evolved above 538° C. (Vacuum resid fraction v. 51.5% for the feedstock; see Example 1 for complete analysis). SimDist analysis for liquid product produced from bitumen feedstock is characterized with approx. 10.6% (wt %) of the feedstock was distilled off below about 232° C. (Kerosene fraction v. 1.0% for the feedstock), approx. 19.7% from about 232° to about 327° C. (Diesel fraction v. 8.6% for the feedstock), and 19.5% evolved above 538° C. (Vacuum resid fraction v. 51.2% for the feedstock; see Example 2 for complete analysis).

Alternate conditions of a two stage process may include a first stage run where the feedstock is preheated to 150° C. and injected into the reactor and processed at about 530° to about 620° C., and with a residence time less than one second within the reactor (see FIG. 2). The product is collected using primary and secondary cyclones (100 and 180 respectively, FIGS. 2 and 4), and the remaining product is transferred to a hot condenser (250). The condensing system (FIG. 4) is engineered to selectively recover the heavy ashphaltene components using a hot condenser (250) placed before the primary condenser (40). The heavy alsphaltenes are collected and returned to the reactor (20) for further processing (i.e., the second stage). The second stage utilizes reactor conditions operating at higher temperatures, or longer residence times, or at higher temperatures and longer residence times (e.g., injection at a lower point in the reactor), than that used in the first stage to optimize the liquid product. Furthermore, a portion of the product stream may be recycled to extinction following this method.

Yet another modification of the composite and two stage processing systems, termed "multi-stage" processing, comprises introducing the primary feedstock (raw feed) into the primary condenser (see FIG. 5) via line 280, and using the primary feedstock to rapidly cool the product vapours within the primary condenser. Product drawn from the primary condenser, is then recycled to the reactor via line 270 for combined "first stage" and "second stage" processing (i.e., recycled processing). The recycled feedstock is exposed to conditions that mildly crack the hydrocarbon components in order to avoid overcracking and excess gas and coke production. An example of these conditions includes, but is not limited to, injecting the feedstock at about 150° C. into a hot gas stream comprise the heat carrier at the inlet of the reactor. The feedstock is processed with a residence time of less than about two seconds within the reactor at a temperature of between about 500° C. to about 600° C. Preferably, the residence time is from about 0.8 to about 1.3 sec., and the reactor temperature is from about 520° to about 580° C. The product, comprising lighter materials (low boilers) is separated (100, and 180, FIG. 5), and removed in the condensing system (40). The heavier materials (240), separated out at the bottom of the condenser (40) are collected and reintroduced into the reactor (20) via line 270. Product gasses that exit the primary condenser (40) enter the secondary condenser (50) where a liquid product of reduced viscosity and high yield (300) is collected (see Example % for run analysis using this method). With multi-stage processing, the feedstock is recycled through the reactor in order to produce a product that can be collected from the second condenser, thereby upgrading and optimizing the properties of the liquid product.

Alternate feeds systems may also be used as required for one, two, composite or multi stage processing. For example, in the system outlined FIG. 5, the feedstock (primary feedstock or raw feed) is obtained from the feed system (10), and is transported within line (280; which may be heated as previously described) to a primary condenser (40). The primary product obtained from the primary condenser may also be recycled back to the reactor (20) within a primary product recycle line (270). The primary product recycle line may be heated if required, and may also comprise a pre-heater unit (290) as shown in FIG. 5, to re-heat the recycled feedstock to desired temperature for introduction within the reactor (20).

Following the recycle process as outlined above and graphically represented in FIG. 5, product with yields of greater than 60, and preferably above 75% (wt %), and with the following characteristics, which are not to be considered limiting in any manner, may be produced from either bitumen or heavy oil feedstocks: an API from about 14 to about 19; viscosity of from about 20 to about 100 (cSt @40° C.); and a low metals content (see Example 5).

From SimDist analysis, liquid products obtained following multi-stage processing of heavy oil can be characterized by comprising at least one of the following properties:

- having less than 50% of their components evolving at temperatures above 538° C. (vacuum resid fraction);
- comprising from about 60% to about 95% of the product evolving below 538°. Preferably, from about 70% to about 90%, and more preferably from about 75 to about 87% of the product evolves during Simulated Distillation below 538° C. (i.e., before the vacuum resid. fraction);
- having from about 1.0% to about 6% of the liquid product evolve below 193° C. Preferably from about 1.2% to about 5%, and more preferably from about 1.3% to about 4.8% evolves below 193° C. (i.e., before the naphtha/kerosene fraction);
- having from about 2% to about 6% of the liquid product evolve between 193-232° C. Preferably from about 2.8% to about 5% evolves between 193-232° C. (diesel fraction);
- having from about 15% to about 25% of the liquid product evolve between 232-327° C. Preferably, from about 18.9 to about 23.1% evolves between 232-327° C. (diesel fraction);
- having from about 8% to about 15% of the liquid product evolve between 327-360° C. Preferably, from about 8.8 to about 10.8% evolves between 327-360° C. (light VGO fraction);
- having from about 40% to about 60% of the liquid product evolve between 360-538° C. Preferably, from about 42 to about 55% evolves between 360-538° C. (Heavy VGO fraction).

The liquid product obtained from multi-stage processing of bitumen may be characterized as having at least one of the following properties:

- having less than 50% of their components evolving at temperatures above 538° C. (vacuum resid fraction);
- comprising from about 60% to about 95% of the product evolving below 538°.

Preferably, from about 60% to about 85% evolves during Simulated Distillation below 538° C. (i.e., before the vacuum resid. fraction);

- having from about 1.0% to about 8% of the liquid product evolve below 193° C. Preferably from about 1.5% to about 7% evolves below 193° C. (i.e., before the naphtha/kerosene fraction);
- having from about 2% to about 6% of the liquid product evolve between 193-232° C. Preferably from about 2.5% to about 5% evolves between 193-232° C. (diesel fraction);
- having from about 12% to about 25% of the liquid product evolve between 232-327° C. Preferably, from about 15 to about 20% evolves between 232-327° C. (diesel fraction);
- having from about 5% to about 12% of the liquid product evolve between 327-360° C. Preferably, from about 6.0 to about 10.0% evolves between 327-360° C. (light VGO fraction);
- having from about 40% to about 60% of the liquid product evolve between 360-538° C. Preferably, from about 35 to about 50% evolves between 360-538° C. (Heavy VGO fraction);

Collectively these results show that a substantial proportion of the components with low volatility in either of the feedstocks have been converted to components of higher volatitly (light naphtha, kerosene and diesel) in the liquid product. These results demonstrate that the liquid product is substantially upgraded, and exhibits properties suitable for transport.

The above description is not intended to limit the claimed invention in any manner; furthermore, the discussed combination of features might not be absolutely necessary for the inventive solution.

The present invention will be further illustrated in the following examples. However it is to be understood that these examples are for illustrative purposes only, and should not be used to limit the scope of the present invention in any manner.

EXAMPLE 1

Heavy Oil (Single Stage)

Pyrolytic processing of Saskatchewan Heavy Oil and Athabasca Bitumen (see Table 1) were carried out over a range of temperatures using a pyrolysis reactor as described in U.S. Pat. No. 5,792,340.

TABLE 1

Characteristics of heavy oil and bitumen feedstocks

| Compound | Heavy Oil[1] | Bitumen[2] |
|---|---|---|
| Carbon (wt %) | 84.27 | 83.31 |
| Hydrogen (wt %) | 10.51 | 10.31 |
| Nitrogen (wt %) | <0.5 | <0.5 |
| Sulphur (st %) | 3.6 | 4.8 |
| Ash (wt %) | 0.02 | 0.02 |
| Vanadium (ppm) | 127 | 204 |
| Nickel (ppm) | Nd | 82 |
| Water content (wt %) | 0.8 | 0.19 |
| Gravity API° | 11.0 | 8.6 |
| Viscosity @ 40° C. (cSt) | 6343 | 30380 |
| Viscosity @ 60° C. (cSt) | 892.8 | 1268.0 |
| Viscosity @ 80° C. (cSt) | 243.4 | 593.0 |
| Aromaticity (C13 NMR) | 0.31 | 0.35 |

[1]Saskatchewan Heavy Oil
[2]Athabasca Bitumen (neat)

Briefly the conditions of processing include a reactor temperature from about 500° to about 620° C. Loading ratios for particulate heat carrier (silica sand) to feedstock of from about 20:1 to about 30:1 and residence times from about 0.35 to about 0.7 sec. These conditions are outlined in more detail below (Table 2).

TABLE 2

Single stage processing of Saskatchewan Heavy Oil

| Crack Temp C. | Viscosity @ 40° C. (cSt) | Yield wt % | Density @ 15° g/ml | API° | Yield Vol % |
|---|---|---|---|---|---|
| 620 | 4.6[1)] | 71.5 | 0.977 | 13.3 | 72.7 |
| 592 | 15.2[1)] | 74.5 | 0.970 | 14.4 | 76.2 |
| 590 | 20.2 | 70.8 | 0.975 | 13.6 | 72.1 |
| 590 | 31.6 | 75.8 | 0.977 | 13.3 | 77.1 |
| 560 | 10.0[1)] | 79.9[2)] | 0.963 | 15.4 | 82.3[2)] |
| 560 | 10.0[1)] | 83.0[3)] | 0.963 | 16.2[3)] | 86.3[3)] |
| 550 | 20.8 | 78.5 | 0.973 | 14.0 | 80.3 |
| 550[4)] | 15.7 | 59.8[2)] | 0.956 | 16.5 | 61.5[2)] |
| 550[4)] | 15.7 | 62.0 | 0.956 | 18.3[2,3] | 65.1[3)] |
| 530 | 32.2 | 80.9[2)] | 0.962 | 15.7 | 82.8[2)] |
| 530 | 32.2 | 83.8[3)] | 0.962 | 16.6[3)] | 87.1[3)] |

[1)]Viscosity @ 80° C.
[2)]Yields do not include overhead condensing
[3)]Estimated yields and API with overhead condensing
[4)]Not all of the liquids were captured in this trial.

The liquid products of the runs at 620° C., 592° C. and 560° C. were analysed for metals, water and sulphur content. These results are shown in Table 3. Nickel, Vanadium and water levels were reduced 72, 69 and 87%, respectively, while sulphur and nitrogen remained the same or were marginally reduced. No metals were concentrated in the liquid product.

TABLE 3

Metal Analysis of Liquid Products (ppm)[1)]

| Component | Saskatchewan Heavy Oil | Run @ 620° C. | Run @ 592° C. | Run @ 560° C. |
|---|---|---|---|---|
| Aluminum | <1 | <1 | 11 | <1 |
| Iron | <1 | 2 | 4 | <1 |
| Nickel | 44 | 10 | 12 | 9 |
| Zinc | 2 | <1 | 2 | 1 |
| Calcium | 4 | 2 | 3 | 1 |
| Magnesium | 3 | 1 | 2 | <1 |
| Boron | 21 | 42 | 27 | <1 |
| Sodium | 6 | 5 | 5 | 4 |
| Silicon | 1 | 10 | 140 | 4 |
| Vanadium | 127 | 39 | 43 | 39 |

TABLE 3-continued

Metal Analysis of Liquid Products (ppm)[1)]

| Component | Saskatchewan Heavy Oil | Run @ 620° C. | Run @ 592° C. | Run @ 560° C. |
|---|---|---|---|---|
| Potassium | 7 | 7 | <1 | 4 |
| Water (wt %) | 0.78 | 0.19 | 0.06 | .10 |
| Sulphur (wt %) | 3.6 | 3.5 | 3.9 | 3.5 |

[1)]Copper, tin, chromium, lead, cadmium, titanium, molybdenum, barium and manganese all showed less than 1 ppm in feedstock and liquid products.

The gas yields for two runs are presented in Table 4.

TABLE 4

Gas analysis of Pyrolysis runs

| Gas (wt %) | Run @ 620° C. | Run @ 560° C. |
|---|---|---|
| Total Gas Yield | 11.8 | 7.2 |
| Ethylene | 27.0 | 16.6 |
| Ethane | 8.2 | 16.4 |
| Propylene | 30.0 | 15.4 |
| Methane | 24.0 | 21.0 |

The pour point of the feedstock improved and was reduced from 32° F. to about −54° F. The Conradson carbon reduced from 12. wt % to about 6.6 wt %.

Based on the analysis of these runs, higher API values and product yields were obtained for crack temperatures of about 530 to about 560° C. At these temperatures, API gravities of 14 to 18.3, product yields of from about 80 to about 87 vol %, and viscosities of from about 15 to about 35 cSt (@40° C.) or about 10 cST (@80° C.) were obtained (the yields from the 550° C. run are not included in this range as the liquid yield capture was not optimized during this run). These liquid products reflect a significant degree of upgrading, and exhibit qualities suitable for pipeline transport.

Simulated distillation (SimDist) analysis of feedstock and liquid product obtained from several separate runs is present in Table 5. SimDist analysis followed the protocol outlined in ASTM D 5307-97, which reports the residue as anything with a boiling point higher than 538° C. Other methods for SimDist may also be used, for example HT 750 (NCUT; which includes boiling point distribution through to 750° C.). These results indicate that over 50% of the components within the feedstock evolve at temperatures above 538° C. These are high molecular weight components with low volatility. Conversely, in the liquid product, the majority of the components, approx 62.1% of the product are more volatile and evolve below 538° C.

TABLE 5

SimDist anlaysis of feedstock and liquid product after single stage processing (Reactor temp 538° C.) Fraction Temp (° C.)

| Fraction | Temp (° C.) | Feedstock | R245 |
|---|---|---|---|
| Light Naphtha | <71 | 0.0 | 0.5 |
| Light/med Naphtha | 71-100 | 0.0 | 0.3 |
| Med Naphtha | 100-166 | 0.0 | 1.4 |
| Naphtha/Kerosene | 166-193 | 0.1 | 1.0 |
| Kerosene | 193-232 | 1.0 | 2.8 |
| Diesel | 232-327 | 8.7 | 14.2 |
| Light VGO | 327-360 | 5.2 | 6.5 |
| Heavy VGO | 360-538 | 33.5 | 35.2 |
| Vacuum Resid/ | >538 | 51.5 | 37.9 |

The feedstock can be further characterized with approx. 0.1% of its components evolving below 193° C. (naphtha/ kerosene fraction), v. approx. 6% for the liquid product. The diesel fraction also demonstrates significant differences between the feedstock and liquid product with 8.7% and 14.2% evolving at this temperature range (232-327° C.), respectively. Collectively these results show that a substantial proportion of the components with low volatility in the feedstock have been converted to components of higher volatility (light naphtha, kerosene and diesel) in the liquid product.

Stability of the liquid product was also determined over a 30-day period (Table 6). No significant change in the viscosity, API or density of the liquid product was observed of a 30-day period.

TABLE 6

Stabilty of liquid products after single stage processing

| Fraction | Time = 0 | 7 days | 14 days | 30 days |
|---|---|---|---|---|
| Density @ 15.6° C. (g · cm$^3$) | 0.9592 | 0.9590 | 0.9597 | 0.9597 |
| API (deg. API) | 15.9 | 15.9 | 15.8 | 15.8 |
| Viscosity @40° C. (cSt) | 79.7 | 81.2 | 81.2 | 83.2 |

EXAMPLE 2

Bitumen (Single Stage)

Several runs using Athabaska Bitumen were conducted using the pyrolysis reactor described in U.S. Pat. No. 5,792,340. The conditions of processing included a reactor temperature from 520° to about 590° C. Loading ratios for particulate heat carrier to feedstock of from about 20:1 to about 30:1, and residence times from about 0.35 to about 1.2 sec. These conditions, and the resulting liquid products are outlined in more detail below (Table 7).

TABLE 7

Single Stage Processing with Undiluted Athabasca Bitumen

| Crack Temp | Viscosity @ 40° C. (cSt) | Yield wt % | Density @ 15° C. | Metals V (ppm)* | Metals Ni (ppm)** | API |
|---|---|---|---|---|---|---|
| 519° C. | 205 | 81.0 | nd | nd | nd | 13.0 |
| 525° C. | 201 | 74.4 | 0.979 | 88 | 24 | 12.9 |

TABLE 7-continued

Single Stage Processing with Undiluted Athabasca Bitumen

| Crack Temp | Viscosity @ 40° C. (cSt) | Yield wt % | Density @ 15° C. | Metals V (ppm)* | Metals Ni (ppm)** | API |
|---|---|---|---|---|---|---|
| 528° C. | 278 | 82.7 | nd | nd | nd | 12.6 |
| 545° C. | 151 | 77.4 | 0.987 | 74 | 27 | 11.8 |
| 590° C. | 25.6 | 74.6 | 0.983 | nd | nd | 12.4 |

*feedstock V209 ppm

**feedstock Ni 86 ppm

These results indicates that undiluted bitumen may be processed according to the method of this invention to produce a liquid product with reduced viscosity from greater than 1300 cSt (@40° C.) to about 25.6-200 cSt (@40° C. (depending on the run conditions; see also Tables 8 and 9), with yields of over 75% to about 85%, and an improvement in the product API from 8.6 to about 12-13. Again, as per Example 1, the liquid product exhibits substantial upgrading of the feedstock. SimDist analysis, and other properties of the liquid product are presented in Table 8, and stability studies in Table 9.

TABLE 8

Properties and SimDist anlaysis of feedstock and liquid product after single stage processing (Reactor temp. 545° C.).

| Fraction | Temp (° C.) | Feedstock | R239 14 days | R239 30 days |
|---|---|---|---|---|
| Density | — | | 0.9871 | 0.9876 |
| API | — | | 11.7 | 11.6 |
| Viscosity @40° C. | — | | 162.3 | 169.4 |
| Light Naphtha | <71 | 0.0 | 0.2 | 0.1 |
| Light/med Naphtha | 71-100 | 0.0 | 0.2 | 0.2 |
| Med Naphtha | 100-166 | 0.0 | 1.5 | 1.4 |
| Naphtha/Kerosene | 166-193 | 0.1 | 1.0 | 1.0 |
| Kerosene | 193-232 | 0.9 | 3.1 | 3.0 |
| Diesel | 232-327 | 8.6 | 15.8 | 14.8 |
| Light VGO | 327-360 | 5.2 | 7.9 | 7.6 |
| Heavy VGO | 360-538 | 34.0 | 43.9 | 42.0 |
| Vacuum Resid. | >538 | 51.2 | 26.4 | 29.9 |

TABLE 9

Stability of liquid products after single stage processing (reactor temperature 525° C.)

| Fraction | Temp (° C.) | Feedstock | R232 Day 0 | R232 7 days | R232 14 days | R232 30 days |
|---|---|---|---|---|---|---|
| Density @15.6° C.* | — | 1.0095 | 0.979 | 0.980 | 0.981 | 0.981 |
| API | — | 8.5 | 12.9 | 12.7 | 12.6 | 12.6 |
| Viscosity @40° C.** | — | 30380 | 201.1 | 213.9 | 214.0 | 218.5 |
| Light Naphtha | <71 | 0.0 | 0.1 | 0.1 | 0.1 | 0.1 |
| Light/med Naphtha | 71-100 | 0.0 | 0.1 | 0.1 | 0.1 | 0.1 |
| Med Naphtha | 100-166 | 0.0 | 1.5 | 1.5 | 1.5 | 1.4 |
| Naphtha/Kerosene | 166-193 | 0.1 | 1.0 | 1.0 | 1.0 | 1.1 |
| Kerosene | 193-232 | 1.0 | 2.6 | 2.6 | 2.6 | 2.7 |
| Diesel | 232-327 | 8.7 | 14.1 | 14.1 | 14.3 | 14.3 |
| Light VGO | 327-360 | 5.2 | 7.3 | 7.3 | 7.4 | 7.4 |
| Heavy VGO | 360-538 | 33.5 | 41.3 | 41.3 | 41.7 | 42.1 |
| Vacuum Resid. | >538 | 51.5 | 32.0 | 32.0 | 31.2 | 30.8 |

*g./cm$^3$

**cSt

The slight variations in the values presented in the stability studies (Table 9 and other stability studies disclosed herein) are within the error of the test methods employed, and are acceptable within the art. These results demonstrate that the liquid products are stable.

These results indicate that over 50% of the components within the feedstock evolve at temperatures above 538° C. (vacuum resid fraction). This fraction is characterized by high molecular weight components with low volatility. Conversely, over several runs, the liquid product is characterized as comprising approx 68 to 74% of the product that are more volatile and evolve below 538° C. The feedstock can be further characterized with approx. 0.1% of its components evolving below 193° C. (naphtha/kerosene fraction), v. approx. 2.7 to 2.9% for the liquid product. The diesel fraction also demonstrates significant differences between the feedstock and liquid product with 8.7% (feedstock) and 14.1 to 15.8% (liquid product) evolving at this temperature range (232-327° C.). Collectively these results show that a substantial proportion of the components with low volatility in the feedstock have been converted to components of higher volatility (light naphtha, kerosene and diesel) in the liquid product. These results demonstrate that the liquid product is substantially upgraded, and exhibits properties suitable for transport.

EXAMPLE 3

Composite/Recycle of Feedstock

The pyrolysis reactor as described in U.S. Pat. No. 5,792,340 may be configured so that the recovery condensers direct the liquid products into the feed line to the reactor (see FIGS. 3 and 4).

The conditions of processing included a reactor temperature ranging from about 530° to about 590° C. Loading ratios for particulate heat carrier to feedstock for the initial and recycle run of about 30:1, and residence times from about 0.35 to about 0.7 sec were used. These conditions are outlined in more detail below (Table 10). Following pyrolysis of the feedstock, the lighter fraction was removed and collected using a hot condenser placed before the primary condenser (see FIG. 4), while the heavier fraction of the liquid product was recycled back to the reactor for further processing (also see FIG. 3). In this arrangement, the recycle stream (260) comprising heavy fractions was mixed with new feedstock (270) resulting in a composite feedstock (240) which was then processed using the same conditions as with the initial run within the pyrolysis reactor.

TABLE 10

Composite/Recycle operation using Saskatchewan Heavy Crude Oil and Undiluted Athabasca Bitumen

| Feedstock | Crack Temp ° C. | Yield Vol % | API° | Recycle[4)] Yield Vol % | Recycle[4)] API° |
|---|---|---|---|---|---|
| Heavy Oil | 590 | 77.1[1)] | 13.3 | 68.6 | 17.1 |
| | 560 | 86.3[2)] | 16.2 | 78.1 | 21.1 |
| | 550 | 50.1[1)] | 14.0 | 71.6 | 17.8 |

TABLE 10-continued

Composite/Recycle operation using Saskatchewan Heavy Crude Oil and Undiluted Athabasca Bitumen

| Feedstock | Crack Temp ° C. | Yield Vol % | API° | Recycle[4)] Yield Vol % | Recycle[4)] API° |
|---|---|---|---|---|---|
| | 550 | 65.1[2,3)] | 18.3 | 56.4 | 22.9 |
| | 530 | 87.1[2)] | 16.6 | 78.9 | 21.0 |
| Bitumen | 590 | 75.2[2)] | 12.4 | 67.0 | 16.0 |

[1)]Yield and API gravity include overhead condensing (actual)

[2)]Yield and API gravity include overhead condensing (estimated)

[3)]Not all of the liquid was recovered in this run

[4)]These values represent the total recovery of product following the recycle run, and presume the removal of approximately 10% heavy fraction, which is recycled to extinction. This is therefore a conservative estimate of yield as some of the heavy fraction will produce lighter # components that enter the product stream, since not all of the heavy fraction will end up as coke.

The API gravity increased from 11.0 in the heavy oil feedstock to about 13 to about 18.5 after the first treatment cycle, and further increases to about 17 to about 23 after a second recycle treatment. A similar increase in API is observed for bitumen having a API of about 8.6 in the feedstock, which increase to about 12.4 after the first run and to 16 following the recycle run. With the increase in API, there is an associated increase in yield from about 77 to about 87% after the first run, to about 67 to about 79% following the recycle run. Therefore associated with the production of a lighter product, there is a decrease in liquid yield. However, an upgraded lighter product may be desired for transport, and recycling of liquid product achieves such a product.

EXAMPLE 4

Two-Stage Treatment of Heavy Oil

Heavy oil or bitumen feedstock may also be processed using a two-stage pyrolytic process which comprises a first stage where the feedstock is exposed to conditions that mildly crack the hydrocarbon components in order to avoid overcracking and excess gas and coke production. Lighter materials are removed following the processing in the first stage, and the remaining heavier materials are subjected to a more severe crack at a higher temperature. The conditions of processing within the first stage include a reactor temperature ranging from about 510 to about 530° C. (data for 515° C. given below), while in the second stage, a temperature from about 590° to about 800° C. (data for 590° C. presented in table 11) was employed. The loading ratios for particulate heat carrier to feedstock range of about 30:1, and residence times from about 0.35 to about 0.7 sec for both stages. These conditions are outlined in more detail below (Table 11).

TABLE 11

Two-Stage Runs of Saskatchewan Heavy Oil

| Crack Temp ° C. | Viscosity @ 80° C. (cSt) | Yield wt % | Density @ 15° C. g/ml | API° | Yield Vol %[1)] |
|---|---|---|---|---|---|
| 515 | 5.3 | 29.8 | 0.943 | 18.6 | 31.4 |
| 590 | 52.6 | 78.9 | 0.990 | 11.4 | 78.1 |
| 515 & 590 | nd | nd | nd | 13.9 | 86.6 |

"nd" means not determined

[1)]Light condensable materials were not captured. Therefore these values are considered estimates.

These results indicate that a mild initial crack which avoids overcracking light materials to gas and coke, followed by a more severe crack of the heavier materials produces a liquid product characterized with an increased API, while still exhibiting good product yields.

Other runs using a two stage processes, involved injecting the feedstock at about 150° C. into a hot gas stream maintained at about 515° C. and entering the reactor at about 300° C. (processing temperature). The product, comprising lighter materials (low boilers) was separated and removed following the first stage in the condensing system. The heavier materials, separated out at the bottom of the cyclone were collected subjected to a more severe crack within the reactor in order to render a liquid product of reduced viscosity and high yield. The conditions utilized in the second stage were a processing temperature of between about 530° to about 590° C. Product from the second stage was processed and collected.

Following such a two-stage process the product of the first stage (light boilers) is characterized with a yield of about 30 vol %, an API of about 19, and a several fold reduction in viscosity over the initial feedstock. The product of the high boiling point fraction, produced following the processing of the recycle fraction in the second stage, is typically characterized with a yield greater than about 75 vol %, and an API gravity of about 12, and a reduced viscosity over the feedstock recycled fraction.

EXAMPLE 5

"Multi-Stage" Treatment of Heavy Oil and Bitumen, Using Feedstock for Quenching within Primary Condenser Heavy oil or bitumen feedstock may also be processed using a "Multi-stage" pyrolytic process as outlined in FIG. 5. In this system, the pyrolysis reactor described in U.S. Pat. No. 5,792,340 is configured so that the primary recovery condenser directs the liquid product into the feed line back to the reactor, and feedstock is introduced into the system at the primary condenser where it quenches the product vapours produced during pyrolysis.

The conditions of processing included a reactor temperature ranging from about 530° to about 590° C. Loading ratios for particulate heat carrier to feedstock for the initial and recycle run of from about 20:1 to about 30:1, and residence times from about 0.35 to about 1.2 sec were used. These conditions are outlined in more detail below (Table 12). Following pyrolysis of the feedstock, the lighter fraction is forwarded to the secondary condenser while the heavier fraction of the liquid product obtained from the primary condenser is recycled back to the reactor for further processing (FIG. 5).

TABLE 12

Characterization of the liquid product obtained following Multi-Stage processing of Saskatchewan Heavy Oil and Bitumen

| Crack Temp ° C. | Viscosity @ 40° C. (cSt) | Yield wt % | Density @ 15.6° C. g/ml | API° | Yield Vol %[1)] |
|---|---|---|---|---|---|
| Heavy Oil | | | | | |
| 543 | 80 | 62.6 | 0.9592 | 15.9 | 64.9 |
| 557 | 24 | 58.9 | 0.9446 | 18.2 | 62.1 |
| 561 | 53 | 70.9 | 0.9568 | 16.8 | 74.0 |
| Bitumen | | | | | |
| 538 | 40 | 61.4 | 0.9718 | 14.0 | 71.1 |

The liquid products produced from multi-stage processing of feedstock exhibit properties suitable for transport with greatly reduced viscosity down from 6343 cSt (@40° C.) for heavy oil and 30380 cSt (@40° C.) for bitumen. Similarly, the API increased from 11 (heavy oil) to from 15.9 to 18.2, and from 8.6 (bitumen) to 14.7. Furthermore, yields for heavy oil under these reaction conditions are from 59 to 68% for heavy oil, and 82% for bitumen.

TABLE 13

Properties and SimDist of liquid products prepared from Heavy Oil using the multi-stage Process (for feedstock properties see Tables 1 and 5).

| Fraction | Temp (° C.) | R241* Day 0 | R241* Day 30 | R242** Day 30 | R244*** Day 30 |
|---|---|---|---|---|---|
| Density @15.6° C.* | — | 0.9592 | 0.9597 | 0.9465 | 0.9591 |
| API | — | 15.9 | 15.8 | 17.8 | 15.9 |
| Viscosity @40° C.** | — | 79.7 | 83.2 | 25.0 | 49.1 |
| Light Naphtha | <71 | 0.0 | 0.2 | 0.3 | 0.3 |
| Light/med Naphtha | 71-100 | 0.0 | 0.1 | 0.2 | 0.3 |
| Med Naphtha | 100-166 | 0.1 | 0.4 | 2.5 | 1.8 |
| Naphtha/Kerosene | 166-193 | 0.6 | 0.6 | 1.8 | 1.5 |
| Kerosene | 193-232 | 2.8 | 2.5 | 5.0 | 3.5 |
| Diesel | 232-327 | 21.8 | 21.0 | 23.1 | 18.9 |
| Light VGO | 327-360 | 10.8 | 10.2 | 9.9 | 8.8 |
| Heavy VGO | 360-538 | 51.1 | 45.0 | 44.9 | 43.2 |
| Vacuum Resid. | >538 | 12.7 | 20.0 | 12.3 | 21.7 |

*reactor temp. 543° C.
**reactor temp. 557° C.
***reactor temp. 561° C.

Under these run conditions the API increased from 11 to about 15.9 to 17.8. Product yields of 62.6 (wt %; R241), 58.9 (wt %; R242) and 70.9 (wt %; R244) were achieved along with greatly reduced viscosity levels. These liquid products have been substantially upgraded over the feedstock and exhibit properties suitable for pipeline transport.

SimDist results indicate that over 50% of the components within the feedstock evolve at temperatures above 538° C. (vacuum resid fraction), while the liquid product is characterized as comprising approx 78 to 87% of the product that are more volatile and evolve below 538° C. The feedstock can be further characterized with approx. 0.1% of its components evolving below 193° C. (naphtha/kerosene fraction), v. approx. 1.3 to 4.8% for the liquid product. The kerosene and diesel fractions also demonstrates significant differences between the feedstock and liquid product with 1% of the feedstock fraction evolving between 193-232° C. v. 2.8 to 5% for the liquid product, and with 8.7% (feedstock) and 18.9 to 23.1% (liquid product) evolving at this temperature range (232-327° C.; diesel). Collectively these results show that a substantial proportion of the components with low volatility in the feedstock have been converted to components of higher volatitly (light naphtha, kerosene and diesel) in the liquid product. These results demonstrate that the liquid product is substantially upgraded, and exhibits properties suitable for transport.

TABLE 14

Properties and SimDist of liquid products prepared from Bitumen following "Two Stage" processing (reactor temp. 538° C.; for feedstock properties see Tables 1, 8 and 9).

| Fraction | Temp (° C.) | R243 |
|---|---|---|
| Density @15.6° C.* | — | 0.9737 |
| API | — | 13.7 |
| Viscosity @40° C.** | — | 45.4 |
| Light Naphtha | <71 | 0.3 |
| Light/med Naphtha | 71-100 | 0.4 |
| Med Naphtha | 100-166 | 3.6 |
| Naphtha/Kerosene | 166-193 | 1.9 |

TABLE 14-continued

Properties and SimDist of liquid products prepared from Bitumen following "Two Stage" processing (reactor temp. 538° C.; for feedstock properties see Tables 1, 8 and 9).

| Fraction | Temp (° C.) | R243 |
|---|---|---|
| Kerosene | 193-232 | 4.4 |
| Diesel | 232-327 | 19.7 |
| Light VGO | 327-360 | 9.1 |
| Heavy VGO | 360-538 | 41.1 |
| Vacuum Resid. | >538 | 19.5 |

Under these run conditions the API increased from 8.6 to about 14. A product yield of 68.4 (wt %) was obtained along with greatly reduced viscosity levels (from 30380 cSt @40° C. in the feedstock, to approx. 45 cSt in the liquid product).

Simulated distillation analysis demonstrates that over 50% of the components within the feedstock evolve at temperatures above 538° C. (vacuum resid fraction) while 80.5% of the liquid product evolves below 538° C. The feedstock can be further characterized with approx. 0.1% of its components evolving below 193° C. (naphtha/kerosene fraction), v. 6.2% for the liquid product. The diesel fraction also demonstrates significant differences between the feedstock and liquid product with 8.7% (feedstock) and 19.7% (liquid product) evolving at this temperature range (232-327° C.). Collectively these results show that a substantial proportion of the components with low volatility in the feedstock have been converted to components of higher volatitly (light naphtha, kerosene and diesel) in the liquid product. These results demonstrate that the liquid product is substantially upgraded, and exhibits properties suitable for transport.

EXAMPLE 6

Further Characterization of Vacuum Gas Oil (VGO)

Vacuum Gas Oil (VGO) was obtained from a range of heavy hydrocarbon feedstocks, including:

- Athabasca bitumen (ATB; ATB-VGO (243) and ATB-VGO (255))
- a hydrotreated VGO from Athabasca bitumen (Hydro-ATB);
- an Athabasca VGO resid blend (ATB-VGO resid);
- a hydrotreated ATB-VGO resid (Hydro-ATB-VGO resid; obtained from the same run as ATB-255); and
- a Kerrobert heavy crude (KHC).

Theses VGO products were obtained using the methods as outlined in Example 4 (two stage; at a reactor temperature of 560°-578° C. with a residence time of 1.209 seconds), except for ATB-VGO (255) which was obtained using the method of Example 1 with an increased residence time (1.705 seconds) and lower reactor temperature (490° C.). The liquid product following thermal processing of the above feedstocks was distilled to produce a VGO fraction using standard procedures disclosed in ASTM D2892 and ASTM D5236.

For hydrotreating the Athabsaca bitumen VGO, the reactor conditions were as follows:

reactor temperature 720° F.;
reactor pressure 15 psig;
Space Velocity 0.5;
Hydrogen rate 3625 SCFB.

Alaskan North Slope crude oil (ANS) was prepared from raw crude using standard procedures in the art (ASTM D2892 and D5236), is provided as a control.

Properties of these VGOs are presented in Table 15.

TABLE 15

Properties of VGOs obtained from a variety of heavy oil feedstocks

| | ATB-VGO (243) | ATB-VGO (255) | ATB-VGO resid | KHC-VGO | ANS-VGO | Hydro-ATB-VGO |
|---|---|---|---|---|---|---|
| API Gravity | 13.8 | 15.2 | 11.8** | 15.5 | 21.7 | 22.4 |
| Sulfur wt % | 3.93 | 3.76 | 4.11** | 3.06 | 1.1 | 0.27 |
| Analine Point, ° F.* | 110 | 125 | 148-150 | 119 | 168 | 133.4 |

*for calculated analine point see Table 17
**estimated

Cracking characteristics of each of the VGOs were determined using Microactivity testing (MAT) under the following conditions (also see Table 16):

reaction temperature 1000° F.;
Run Time 30 seconds;
Cat-to-oil-Ratio 4.5;
Catalyst Equilibrium FCC Catalyst.

The results from MAT testing are provided in Table 16, and indicate that cracking conversion for ATB-VGO (243), is approximately 63%, for KHC-VGO is about 6%, for ANS-VGO it is about 73%, and for Hydro-ATB-VGO is about 74%. Furthermore, cracking conversion for Hydro-ATB-VGO resid (obtained from ATB-255) is about 3% on volume higher than the VGO from the same run (i.e., ATB-VGO (255)). The modeling for the ATB-VGO resid and hydro-ATB-VGO resid incorporate a catalyst cooling device to maintain the regenerator temperature within its operating limits.

TABLE 16

Microcativity Testing (MAT) results

| | ATB-VGO (243) | ATB-VGO (255) | KHC-VGO | ANS-VGO | Hydro-ATB-VGO | ATB-VGO resid |
|---|---|---|---|---|---|---|
| Catalyst Charge (grams) | 4.5054 | 4.5137 | 4.506 | 4.5064 | 4.5056 | 4.5238 |
| Feed Charge (grams) | 1.0694 | 1.055 | 1.0553 | 1.0188 | 1 | 1.0753 |
| Catalyst/oil Ratio | 4.2 | 4.3 | 4.3 | 4.4 | 4.5 | 4.2 |
| Preheat Temperature (° F.) | 1015 | 1015 | 1015 | 1015 | 1015 | 1015 |
| Bed Temperature (° F.) | 1000 | 1000 | 1000 | 1000 | 1000 | 1000 |
| Oil Inject Time (sec) | 30 | 30 | 30 | 30 | 30 | 30 |
| Conversion (Wt %) | 62.75% | 65.69 | 65.92 | 73.02 | 74.08 | 65.24 |

TABLE 16-continued

| Microcativity Testing (MAT) results | | | | | | |
|---|---|---|---|---|---|---|
| | ATB-VGO (243) | ATB-VGO (255) | KHC-VGO | ANS-VGO | Hydro-ATB-VGO | ATB-VGO resid |
| Normalize (Wt %) H2S | 2.22% | 2.28% | 1.90% | 0.79% | 0.13% | 2.43% |
| H2 | 0.19% | 0.16% | 0.18% | 0.17% | 0.24% | 0.16% |
| CH4 | 1.44% | 1.24% | 1.33% | 1.12% | 1.07% | 1.34% |
| C2H2 | 0.00% | 0.00% | 0.00% | 0.00% | 0.00% | 0.00% |
| C2H4 | 1.01% | 0.94% | 1.05% | 0.97% | 0.93% | 0.91% |
| C2H6 | 1.03% | 0.86% | 0.94% | 0.76% | 0.66% | 0.94% |
| C3H4 | 0.00% | 0.00% | 0.00% | 0.00% | 0.00% | 0.00% |
| C3H6 | 4.11% | 3.99% | 4.39% | 5.15% | 4.55% | 3.73% |
| C3H6 | 1.01% | 1.01% | 1.06% | 1.16% | 1.01% | 1.00% |
| C4H6 | 0.00% | 0.00% | 0.00% | 0.00% | 0.00% | 0.00% |
| 1-C4H8 | 0.90% | 1.71% | 1.02% | 1.19% | 1.09% | 0.81% |
| 1-C4H8 | 0.96% | 0.69% | 0.92% | 1.05% | 0.83% | 0.79% |
| c-2-C4H8 | 0.69% | 0.69% | 0.81% | 0.97% | 0.80% | 0.65% |
| t-2-C4H8 | 0.98% | 0.43% | 1.13% | 1.36% | 1.14% | 0.91% |
| 1-C4H10 | 2.58% | 2.65% | 3.20% | 4.31% | 4.59% | 2.44% |
| N—C4H10 | 0.38% | 0.48% | 0.50% | 0.65% | 0.63% | 0.48% |
| C5-430° F. | 39.53% | 43.54% | 42.35% | 49.10% | 52.67% | 41.97% |
| 430° F.-650° F. | 23.29% | 22.50% | 22.30% | 18.75% | 18.92% | 22.60% |
| 650° F.-800° F. | 10.71% | 8.86% | 9.03% | 6.06% | 5.27% | 8.85% |
| 800° F. | 3.24% | 2.94% | 2.75% | 2.17% | 1.74% | 3.31% |
| Coke | 5.73% | 5.04% | 5.13% | 4.28% | 3.73% | 6.69% |
| Material Balance | 97.93% | 98.04% | 98.03% | 96.59% | 97.10% | 98.16% |

Analine points were determined using ASTM Method D611. The results, as well as conversion and yield on the basis of vol % are presented in Table 17A and B. Similar results were obtained when compared on a wt % basis (data not shown). Cracking conversion for ATB-VGO (243) and KHC-VGO is 21% and 16% on volume lower that for ANS VGO. Hydrotreated ATB is 5% on volume lower that ANS-VGO.

TABLE 17A

| Measured Analine Point on a vol % basis | | | | | |
|---|---|---|---|---|---|
| | ANS-VGO Vol % FF | ATB-VGO (243) Vol % FF | Hydro-ATB-VGO Vol % FF | KHC-VGO Vol % FF | ATB-VGO (255) Vol % FF |
| Fresh Feed Rate MBPD | 68.6 | 68.6 | 68.6 | 68.6 | 68.6 |
| Riser Outlet Temperature ° F. | 971 | 971 | 971 | 971 | 971 |
| Fresh Feed Temperature ° F. | 503 | 503 | 503 | 503 | 503 |
| Regenerator Temperature ° F. | 1334 | 1609 | 1375 | 1562 | 1511 |
| Conversion | 73.85 | 53.01 | 68.48 | 58.58 | 56.53 |
| C2 and Lighter, wt % FF | 4.13 | 8.19 | 4.53 | 7.70 | 7.37 |
| H2S | 0.54 | 1.37 | 0.12 | 1.18 | 1.35 |
| H2 | 0.18 | 0.21 | 0.22 | 0.25 | 0.20 |
| Methane | 1.35 | 2.87 | 1.65 | 2.65 | 2.45 |
| Ethylene | 1.00 | 1.37 | 1.31 | 1.51 | 1.31 |
| Ethane | 1.07 | 2.36 | 1.23 | 2.11 | 2.06 |
| Total C3 | 9.41 | 7.15 | 10.01 | 8.18 | 7.50 |
| Propylene | 7.37 | 5.79 | 7.81 | 6.54 | 6.06 |
| Propane | 2.04 | 1.35 | 2.20 | 1.64 | 1.44 |
| Total C4 | 13.79 | 9.35 | 13.05 | 11.57 | 10.34 |
| Isobutane | 4.25 | 2.40 | 4.85 | 3.21 | 2.65 |
| N-Butane | 1.08 | 0.35 | 1.07 | 0.53 | 0.39 |
| Total Butenes | 8.46 | 6.60 | 7.13 | 7.83 | 7.30 |
| Gasoline (C5-430° F.) | 58.46 | 35.35 | 51.56 | 39.43 | 38.58 |
| LCGO (430-650° F.) | 20.78 | 34.74 | 27.08 | 32.06 | 32.05 |
| HCGO + DO 650° F. | 5.37 | 12.25 | 4.44 | 10.36 | 11.42 |
| Coke, Wt % | 5.50 | 5.835.50 | 5.53 | 5.82 | 5.70 |
| API Gravity | 21.7 | 13.9 | 22.4 | 15.5 | 15.2 |
| Aniline Point ° F. (Measured) | 168 | 110 | 133.4 | 119.0 | 125 |

The difference in the conversion for ATB-VGO, KHC-VGO and Hydro-ATB-VGO relative to ANS-VGO (control) listed in Table 17A is larger than expected, when the results of the MAT test (Table 16) are considered. This true for ATB-VGO (243), (255), KHC-VGO, Hydro-ATB-VGO, ATB-VGO-resid, and Hydro ATB-VGO-resid. To determine if the measured analine point is not a reliable indicator of the ATB-, KHC- and Hydro-VGOs, the analine point was calculated using standard methods known in the art based, upon distillation data and API gravity. The calculated analine points, and cracking conversion for the various VGO's are presented in Tables 17B and C.

TABLE 17B

Calculated Analine Point on a vol % basis

| | ANS-VGO Vol % FF | ATB-VGO (243) Vol % FF | Hydro-ATB-VGO Vol % FF | KHC-VGO Vol % FF |
|---|---|---|---|---|
| Fresh Feed Rate MBPD | 68.6 | 68.6 | 68.6 | 68.6 |
| Riser Outlet Temperature ° F. | 971 | 971 | 971 | 971 |
| Fresh Feed Temperature ° F. | 503 | 503 | 503 | 503 |
| Regenerator Temperature ° F. | 1334 | 1464 | 1272 | 1383 |
| Conversion | 73.85 | 57.45 | 74.25 | 62.98 |
| C2 and Lighter, wt % FF | 4.13 | 6.79 | 3.53 | 6.05 |
| H2S | 0.54 | 1.40 | 0.13 | 1.25 |
| H2 | 0.18 | 0.17 | 0.18 | 0.16 |
| Methane | 1.35 | 2.14 | 1.21 | 1.86 |
| Ethylene | 1.00 | 1.19 | 1.07 | 1.20 |
| Ethane | 1.07 | 1.89 | 0.94 | 1.57 |
| Total C3 | 9.41 | 7.33 | 10.10 | 8.27 |
| Propylene | 7.37 | 5.93 | 8.10 | 6.59 |
| Propane | 2.04 | 1.40 | 2.00 | 1.68 |
| Total C4 | 13.79 | 10.76 | 15.26 | 12.18 |
| Isobutane | 4.25 | 2.75 | 5.01 | 3.37 |
| N-Butane | 1.08 | 0.41 | 1.18 | 0.54 |
| Total Butenes | 8.46 | 7.60 | 9.07 | 8.27 |
| Gasoline (C5-430° F.) | 58.46 | 39.71 | 57.07 | 45.57 |
| LCGO (430-650° F.) | 20.78 | 30.85 | 22.20 | 27.70 |
| HCGO + DO 650° F. | 5.37 | 11.70 | 3.55 | 9.32 |
| Coke, Wt % | 5.50 | 5.56 | 5.33 | 5.46 |
| API Gravity | 21.7 | 13.8 | 22.4 | 15.5 |
| Aniline Point ° F. (Measured) | 168 | 135.0 | 158.0 | 144.0 |

TABLE 17C

Calculated Analine Point on a vol % basis, continued

| | ATB-VGO (255) Vol % FF | Hydro-ATB-VGO (255) Vol % FF | ATB-VGO resid Vol % FF | Hydro ATB-VGO resid Vol % FF |
|---|---|---|---|---|
| Fresh Feed Rate MBPD | 68.6 | 68.6 | 68.6 | 68.6 |
| Riser Outlet Temperature ° F. | 971 | 971 | 971 | 971 |
| Fresh Feed Temperature ° F. | 503 | 503 | 503 | 503 |
| Regenerator Temperature ° F. | 1374 | 1238 | 1345* | 1345* |
| Conversion | 60.86 | 75.29 | 83.82 | 72.34 |
| C2 and Lighter | 6.13 | 3.36 | 4.80 | 4.13 |
| H2S | 1.42 | 0.12 | 1.55 | 0.04 |
| H2 | 0.14 | 0.17 | 0.18 | 0.60 |
| Methane | 1.85 | 1.13 | 1.43 | 1.56 |

TABLE 17C-continued

Calculated Analine Point on a vol % basis, continued

| | ATB-VGO (255) Vol % FF | Hydro-ATB-VGO (255) Vol % FF | ATB-VGO resid Vol % FF | Hydro ATB-VGO resid Vol % FF |
|---|---|---|---|---|
| Ethylene | 1.10 | 1.04 | 0.48 | 0.79 |
| Ethane | 1.63 | 0.89 | 1.17 | 1.14 |
| Total C3 | 7.54 | 10.44 | 7.66 | 8.49 |
| Propylene | 6.07 | 8.62 | 5.97 | 6.76 |
| Propane | 1.47 | 1.82 | 1.69 | 1.73 |
| Total C4 | 11.58 | 16.56 | 12.99 | 12.60 |
| Isobutane | 2.96 | 4.96 | 3.34 | 3.75 |
| N-Butane | 0.44 | 1.19 | 0.49 | 0.99 |
| Total Butenes | 8.18 | 10.40 | 9.16 | 7.85 |
| Gasoline (C5-430° F.) | 43.38 | 56.87 | 45.61 | 56.66 |
| LCGO (430-650° F.) | 28.61 | 21.09 | 26.28 | 21.59 |
| HCGO + DO (650° F.) | 10.52 | 3.62 | 9.89 | 6.06 |
| Coke, Wt % FF | 5.43 | 5.30 | 7.54 | 6.42 |
| API Gravity (Feed) | 15.2 | 23.9 | 11.8 | 20.0 |
| Aniline Point ° F. (Calc) | 145 | 168 | 148.0 | 170.0 |

Based upon the calculated analine points, the analine point all increased and are more in keeping with the data determined from MAT testing. For example, the analine point of:

ATB-VGO (243) is 135° F.,

ATB-VGO (255) is 145° F.,

KHC-VGO is 144° F.,

ATB-VGO-resid is 148° F.,

Hydro-ATB-VGO is 158° F., and

Hydro-ATB-VGO-resid is 170° F.

There is no change in the analine point or product yield for the ANS-VGO (control). Along with the increased calculated analine points were increased product yields are consistent with the cracking differences MAT results of Table 16.

These results indicate that VGOs prepared from liquid products following rapid thermal processing as described herein (e.g., ATB-VGO, KHC-VGO and Hydro-ATB-VGO) are substantially different from VGOs obtained from similar feedstocks that have been only processed using conventional methods (e.g., distillation), for example ANS-VGO. Further analysis of the above VGOs obtained following rapid thermal processing indicates that they are characterized by having a unique hydrocarbon profile comprising about 38% mono-aromatics plus thiophene aromatics. These types of molecules have a plurality of side chains available for cracking, and provide higher levels of conversion.

All citations are herein incorporated by reference.

The present invention has been described with regard to preferred embodiments. However, it will be obvious to persons skilled in the art that a number of variations and modifications can be made without departing from the scope of the invention as described herein.

The invention claimed is:

1. A method of producing a vacuum gas oil (VGO), comprising

I) upgrading bitumen by a method comprising:

i) providing a particulate heat carrier into an upflow reactor;

ii) introducing the bitumen into the upflow reactor at at least one location above that of the particulate heat carrier so that a loading ratio of the particulate heat carrier to the bitumen is from about 10:1 to about 200:1, wherein the upflow reactor is run at a temperature of from about 300° C. to about 700° C.;

iii) allowing the bitumen to interact with the heat carrier with a residence time of less than about 5 seconds, to produce a product stream;

iv) separating the product stream from the particulate heat carrier;

v) regenerating the particulate heat carrier; and vi) collecting a gaseous and liquid product from the product stream, wherein the liquid product exhibits an increased API gravity, a reduced pour point, reduce viscosity and a reduced level of contaminants over that of the feedstock, and II) isolating the VGO from the liquid product, wherein the VGO is characterized as comprising a measured analine point from about 110° F. to about 170° F., wherein the measured analine point is lower than a calculated analine point.

2. The method of claim 1, wherein the method further comprises recycling the regenerated particulate heat carrier to the upflow reactor.

3. The method of claim 1, wherein the VGO is suitable for FCC and comprises about 38% mono-aromatics plus thiophene aromatics.

4. The method of claim 1, wherein the VGO collected from the liquid product is provided at a yield greater than 80% by volume relative to the heavy hydrocarbon feedstock.

5. The method of claim 1, wherein the VGO has a viscosity that is at least 25 times lower than that of the heavy hydrocarbon feedstock.

6. The method of claim 1, wherein the VGO has an API gravity of at least about 14.

7. The method of claim 1, wherein the liquid product is collected from the product stream by cooling the product stream to less than 400 C. and then passing the resulting vapor stream through a secondary condensor.

8. The method of claim 1, wherein the liquid product is a stable liquid product having no significant change in viscosity, API, or density after 30 days.

9. The method of claim 1, wherein the liquid product has a viscosity of 25.6 to 200 cSt at 40 C.

10. The method of claim 1, wherein the API of the VGO is increased by hydrotreating.

* * * * *